US007518592B2

(12) United States Patent
Koyama et al.

(10) Patent No.: US 7,518,592 B2
(45) Date of Patent: Apr. 14, 2009

(54) LIQUID CRYSTAL DISPLAY DEVICE

(75) Inventors: Jun Koyama, Kanagawa (JP); Tomoaki Atsumi, Kanagawa (JP); Hiroyuki Miyake, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 0 days.

(21) Appl. No.: 11/622,510

(22) Filed: Jan. 12, 2007

(65) Prior Publication Data

US 2007/0109247 A1 May 17, 2007

Related U.S. Application Data

(63) Continuation of application No. 09/969,591, filed on Oct. 4, 2001, now Pat. No. 7,184,014.

(30) Foreign Application Priority Data

Oct. 5, 2000 (JP) ..... 2000-305642

(51) Int. Cl.
*G09G 3/36* (2006.01)

(52) U.S. Cl. ..... 345/100; 345/87; 345/98

(58) Field of Classification Search ..... 345/87–100, 345/204

See application file for complete search history.

(56) References Cited

U.S. PATENT DOCUMENTS 4,432,610 A 2/1984 Kobayashi
4,636,788 A 1/1987 Hilbrink
4,752,118 A 6/1988 Johnson
4,773,738 A 9/1988 Hayakawa
4,996,523 A 2/1991 Bell
5,091,722 A 2/1992 Kitajima (Continued)

FOREIGN PATENT DOCUMENTS

EP 07 174 45 6/1996

(Continued)

OTHER PUBLICATIONS

M.A. Baldo et al.; "Highly efficient phosphorescent emission from organic electroluminescent devices"; *Nature*, vol. 395; pp. 151-154; Sep. 10, 1998.

(Continued)

*Primary Examiner*—Richard Hjerpe
*Assistant Examiner*—Kimnhung Nguyen
(74) *Attorney, Agent, or Firm*—Fish & Richardson P.C.

(57) ABSTRACT

A liquid crystal display device with low power consumption is provided. In the liquid crystal display device having a source signal line driver circuit, a gate signal line driver circuit, a DAC controller, and a pixel portion and performing an image display using an n-bit (n is a natural number, n≧2) digital image signal, one pixel has memory circuits for storing an n-bit digital image signal and a D/A converter, and the n-bit digital image signal for one frame can be stored in the pixel. In case of a static image display, the image signal stored in the memory circuits is read out every frame to perform the display, and thus, only a DAC controller is driven during the display. Therefore, this contributes to a reduction of the power consumption of the entire liquid crystal display device.

16 Claims, 23 Drawing Sheets

U.S. PATENT DOCUMENTS

| | | | | |
|---|---|---|---|---|
| 5,125,045 | A | 6/1992 | Murakami | |
| 5,200,846 | A | 4/1993 | Hiroki | |
| 5,225,823 | A | 7/1993 | Kanaly | |
| 5,247,190 | A | 9/1993 | Friend | |
| 5,339,090 | A | 8/1994 | Crossland | |
| 5,349,366 | A | 9/1994 | Yamazaki | |
| 5,376,944 | A | 12/1994 | Mogi | |
| 5,424,752 | A | 6/1995 | Yamazaki | |
| 5,471,225 | A | 11/1995 | Parks | |
| 5,479,283 | A | 12/1995 | Kaneko | |
| 5,600,169 | A | 2/1997 | Burgener | |
| 5,608,549 | A | 3/1997 | Usami | |
| 5,642,129 | A | 6/1997 | Zavracky | |
| 5,673,422 | A | 9/1997 | Kawai | |
| 5,699,078 | A | 12/1997 | Yamazaki | |
| 5,712,652 | A | 1/1998 | Sato | |
| 5,771,031 | A | 6/1998 | Kinoshita | |
| 5,793,344 | A | 8/1998 | Koyama | |
| 5,798,746 | A | 8/1998 | Koyama | |
| 5,818,898 | A | 10/1998 | Tsukamoto | |
| 5,841,482 | A | 11/1998 | Wang | |
| 5,854,628 | A | 12/1998 | Nakagawa | |
| 5,907,313 | A | 5/1999 | Kubota | |
| 5,945,866 | A | 8/1999 | Fonash | |
| 5,945,972 | A | 8/1999 | Okumura | |
| 5,959,598 | A | 9/1999 | McKnight | |
| 5,977,940 | A | 11/1999 | Akiyama | |
| 5,990,629 | A | 11/1999 | Yamada | |
| 6,115,019 | A | 9/2000 | Perner | |
| 6,165,824 | A | 12/2000 | Takano | |
| 6,246,386 | B1 | 6/2001 | Perner | |
| 6,259,846 | B1 | 7/2001 | Roach | |
| 6,274,887 | B1 | 8/2001 | Yamazaki | |
| 6,333,737 | B1 | 12/2001 | Nakajima | |
| 6,335,728 | B1 | 1/2002 | Kida | |
| 6,344,672 | B2 | 2/2002 | Huffman | |
| 6,344,843 | B1 | 2/2002 | Koyama | |
| 6,356,028 | B1 | 3/2002 | Legagneux | |
| 6,366,026 | B1 | 4/2002 | Saito | |
| 6,377,492 | B1 * | 4/2002 | Rong et al. | 365/189.02 |
| 6,380,876 | B1 | 4/2002 | Nagao | |
| 6,384,818 | B1 | 5/2002 | Yamazaki | |
| 6,392,618 | B1 | 5/2002 | Kimura | |
| 6,441,829 | B1 | 8/2002 | Blalock | |
| 6,445,368 | B1 | 9/2002 | Nakajima | |
| 6,456,267 | B1 | 9/2002 | Sato | |
| 6,496,130 | B2 | 12/2002 | Nagao | |
| 6,535,192 | B1 | 3/2003 | Sung | |
| 6,542,139 | B1 | 4/2003 | Kanno | |
| 6,545,654 | B2 | 4/2003 | Jacobsen et al. | |
| 6,545,708 | B1 | 4/2003 | Tamayama | |
| 6,549,196 | B1 | 4/2003 | Taguchi | |
| 6,556,176 | B1 | 4/2003 | Okuyama | |
| 6,563,480 | B1 | 5/2003 | Nakamura | |
| 6,564,237 | B2 | 5/2003 | Ohashi | |
| 6,579,736 | B2 | 6/2003 | Yamazaki | |
| 6,580,454 | B1 | 6/2003 | Perner | |
| 6,583,775 | B1 | 6/2003 | Sekiya | |
| 6,630,916 | B1 | 10/2003 | Shinoda | |
| 6,636,191 | B2 | 10/2003 | Cok | |
| 6,636,194 | B2 | 10/2003 | Ishii | |
| 6,664,943 | B1 | 12/2003 | Nakajima | |
| 6,670,938 | B1 | 12/2003 | Yoshida | |
| 6,683,596 | B2 | 1/2004 | Ozawa | |
| 6,693,616 | B2 | 2/2004 | Koyama | |
| 6,730,966 | B2 | 5/2004 | Koyama | |
| 6,731,264 | B2 | 5/2004 | Koyama | |
| 6,731,272 | B2 | 5/2004 | Huang | |
| 6,738,054 | B1 | 5/2004 | Yamaguchi | |
| 6,747,623 | B2 | 6/2004 | Koyama | |
| 6,750,836 | B1 | 6/2004 | Katayama | |
| 6,753,834 | B2 | 6/2004 | Mikami | |
| 6,765,562 | B2 | 7/2004 | Yamazaki | |
| 6,774,876 | B2 | 8/2004 | Inukai | |
| 6,775,246 | B1 | 8/2004 | Kuribayashi | |
| 6,819,317 | B1 | 11/2004 | Komura | |
| 6,940,496 | B1 * | 9/2005 | Kim | 345/204 |
| 6,987,496 | B2 | 1/2006 | Koyama | |
| 6,992,652 | B2 | 1/2006 | Koyama | |
| 7,023,413 | B1 * | 4/2006 | Terashima et al. | 345/98 |
| 7,151,511 | B2 | 12/2006 | Koyama | |
| 7,180,496 | B2 | 2/2007 | Koyama et al. | |
| 7,184,014 | B2 * | 2/2007 | Koyama et al. | 345/100 |
| 7,196,709 | B2 | 3/2007 | Kurokawa et al. | |
| 7,224,339 | B2 | 5/2007 | Koyama et al. | |
| 7,227,542 | B2 | 6/2007 | Koyama | |
| 7,250,927 | B2 | 7/2007 | Yamazaki et al. | |
| 2001/0005193 | A1 | 6/2001 | Yokoyama | |
| 2002/0000969 | A1 | 1/2002 | Ozawa | |
| 2002/0003521 | A1 | 1/2002 | Matsueda | |
| 2002/0018029 | A1 | 2/2002 | Koyama | |
| 2002/0018131 | A1 | 2/2002 | Kochi | |
| 2002/0021274 | A1 | 2/2002 | Koyama | |
| 2002/0021295 | A1 | 2/2002 | Koyama | |
| 2002/0024054 | A1 | 2/2002 | Koyama | |
| 2002/0024485 | A1 | 2/2002 | Koyama | |
| 2002/0036604 | A1 | 3/2002 | Yamazaki | |
| 2002/0036611 | A1 | 3/2002 | Ishii | |
| 2002/0039087 | A1 | 4/2002 | Inukai | |
| 2002/0041266 | A1 | 4/2002 | Koyama | |
| 2002/0057244 | A1 | 5/2002 | Koyama | |
| 2002/0089483 | A1 | 7/2002 | Yamazaki | |
| 2002/0113763 | A1 | 8/2002 | Koyama | |
| 2002/0130828 | A1 | 9/2002 | Yamazaki | |
| 2003/0067632 | A1 | 4/2003 | Ohta | |
| 2003/0071772 | A1 | 4/2003 | Kimura | |
| 2003/0098875 | A1 | 5/2003 | Kurokawa | |
| 2003/0103025 | A1 | 6/2003 | Kurokawa | |
| 2004/0085269 | A1 | 5/2004 | Mikami | |
| 2004/0164322 | A1 | 8/2004 | Kondo | |
| 2004/0183766 | A1 | 9/2004 | Koyama | |
| 2004/0222955 | A1 | 11/2004 | Koyama | |

FOREIGN PATENT DOCUMENTS

| | | |
|---|---|---|
| EP | 0 999 595 | 5/2000 |
| EP | 1 098 290 | 5/2001 |
| EP | 1 182 638 | 2/2002 |
| JP | 04-350627 | 12/1992 |
| JP | 06-102530 | 4/1994 |
| JP | 08-101609 | 4/1996 |
| JP | 08-101669 | 4/1996 |
| JP | 08-194205 | 7/1996 |
| JP | 08-241048 | 9/1996 |
| JP | 08-286170 | 11/1996 |
| JP | 09-212140 | 8/1997 |
| JP | 10-092576 | 4/1998 |
| JP | 10-214060 | 8/1998 |
| JP | 10-232649 | 9/1998 |
| JP | 10-247735 | 9/1998 |
| JP | 10-253941 | 9/1998 |
| JP | 10-312173 | 11/1998 |
| JP | 11-064814 | 3/1999 |

OTHER PUBLICATIONS

M.A. Baldo et al.; "Very high-efficiency green organic light-emitting devices based on electrophosphorescence"; *Applied Physics Letters*, vol. 75, No. 1; pp. 4-6; Jul. 5, 1999.

Han et al., "Green OLED with Low Temperature Poly-Si TFT," EuroDisplay '99, Late-News Papers, Sep. 6-9, 1999, pp. 27-30.

Jun Koyama et al.; "A 4.0-in. Poly Si TFT-LCD with Integrated 6-bit Digital Data Driver Using CGS Technology"; AM-LCD99: *Digest of Technical Papers*; Japanese Society of Applied Physics; pp. 29-32; Jul. 14-16, 1999.

Chinese Office Action (Application No. 001126012.2), dated Mar. 18, 2005, 7 pages.

Tetsuo Tsutsui et al.; "Electroluminescence in Organic Thin Films"; *Photochemical Processes in Organized Molecular Systems*; pp. 437-450; 1991.

Schenk et al., "Polymers for Light Emitting Diodes," EuroDisplay '99, Sep. 6-9, 1999, pp. 33-37.

Shimoda et al., "Invited Paper: Current Status and Future of Light-Emitting Polymer Display Driven by Poly-Si TFT," SID 99 Digest, Jan. 1, 1999, pp. 372-375.

Shimoda et al., "High Resolution Light Emitting Polymer Display Driven by Low Temperature Polysilicon Thin Film Transistor with Integrated Driver," Asia Display 1998, Jan. 1, 1998, pp. 217-220.

T. Tsutsui, et al., "High Quantum Efficiency In Organic Light-Emitting Devices With Iridium-Complex As A Triplet Emissive Center," Japan Journal of Applied Physics, vol. 38, Part 2, No. 12B, pp. L1502-L1504, Dec. 15, 1999.

Office Action (U.S. Appl. No. 09/919,832), dated Sep. 8, 2004.

Office Action (U.S. Appl. No. 09/923,433), dated Jul. 28, 2004.

Office Action (U.S. Appl. No. 09/930,956), dated Nov. 4, 2004.

Office Action (U.S. Appl. No. 09/930,956), dated Apr. 19, 2004.

Office Action (U.S. Appl. No. 09/930,956), dated Oct. 28, 2003.

Office Action (U.S. Appl. No. 09/916,306), dated Jan. 25, 2005.

Office Action (U.S. Appl. No. 09/930,956), dated May 2, 2005.

Office Action (U.S. Appl. No. 09/931,061), dated Mar. 22, 2005.

* cited by examiner

LIQUID CRYSTAL DISPLAY DEVICE

BACKGROUND OF THE INVENTION

1. Field of the Invention

The present invention relates to a display device and a driver circuit of the display device, particularly to an active matrix display device having thin film transistors formed on an insulator and a driver circuit of the active matrix display device. More particularly, the present invention relates to an active matrix liquid crystal display device using a digital image signal as an image source and a driver circuit of the active matrix liquid crystal display device.

2. Description of the Related Art

In recent years, a display device having a semiconductor film formed on an insulator, particularly on a glass substrate, particularly an active matrix display device using thin film transistors (hereinafter referred to as TFTs) have been spreading. The active matrix display device using TFTs has several hundred thousands to several millions of TFTs arranged in matrix and performs an image display by controlling a charge of each pixel.

Further, as a recent technique, a technique relating to a polysilicon TFT for simultaneously forming a driver circuit in the peripheral portion of a pixel portion with a pixel TFT constituting a pixel is developing, which greatly contributes to miniaturization and lower power consumption of a device. Along with this, a liquid crystal display device has been becoming an essential device for a display portion of a mobile apparatus etc. in which the applied field has been remarkably expanding in recent years.

A schematic diagram of an active matrix liquid crystal display device of a normal digital system is shown in FIG. 14A. A pixel portion 1404 is arranged in the center of a substrate 1401. On the upper side of the pixel portion, a source signal line driver circuit 1402 for controlling source signal lines is arranged. On the right and left sides of the pixel portion, gate signal line driver circuits 1403 for controlling gate signal lines are arranged. Although symmetrically arranged on the right and left sides of the pixel portion in FIG. 14A, the gate signal line driver circuit 1403 may be arranged on one side. However, the arrangement on both sides is desirable from the viewpoint of driving efficiency and driving reliability of the liquid crystal display device. Input of signals to the respective driver circuits from the outside is conducted through flexible printed circuits (FPCs) 1405.

FIG. 14B is an enlarged view of a circuit diagram of a portion of 2×2 pixels surrounded by a dotted line frame 1406 in the pixel portion 1404 in FIG. 14A. One pixel has a source signal line 1451, a gate signal line 1452, a pixel TFT 1453, a liquid crystal 1454, and a storage capacitor 1455.

The source signal line driver circuit 1402 has the structure shown in FIG. 15, for example. The driver circuit shown as an example in FIG. 15 is a source signal line driver circuit corresponding to a 3-bit digital gradation display, which has a shift register circuit (SR) 1501, a first latch circuit (LAT1) 1502, a second latch circuit (LAT2) 1503, a D/A (digital/analog) converter (DAC) 1504 and the like. Note that although not shown in FIG. 15, a buffer circuit, a level shifter circuit and the like may be arranged if necessary.

The operation is simply described with reference to FIG. 15. First, the shift register circuit 1501 is input with clock signals (S-CLK, S-CLKb) and a start pulse (S-SP), and sampling pulses are sequentially output. Then, the sampling pulses are input to the first latch circuit 1502, and in accordance with this timing, digital image signals (digital data) also input to the first latch circuit 1502 are respectively held. Here, D2 is the most significant bit (MSB) and D0 is the least significant bit (LSB). In the first latch circuit 1502, after the completion of holding the digital image signals for one horizontal period, the digital image signals held in the first latch circuit 1502 are simultaneously transferred to the second latch circuit 1503 in accordance with the input of latch signals (latch pulses) in a return line period.

Thereafter, the shift register circuit 1501 is operated again, and holding of digital image signals for the next horizontal period is started. On the other hand, at the same time, the digital image signals held in the second latch circuit 1503 are converted into analog image signals in the D/A converter 1504. The digital image signal converted into an analog image signal is written into a pixel 1505 of one row in a state that the gate signal line is selected through the source signal line. This operation is repeated, and thus, the image display is conducted.

In a general active matrix liquid crystal display device, renewal of a screen display is conducted about sixty times per second in order to smoothly perform a display of moving images. That is, it is necessary that every time a digital image signal is supplied each one frame, write into a pixel is conducted. Even if the image is a static image, the same signal has to be continuously supplied every one frame. Thus, it is necessary that the driver circuit continuously and repeatedly performs the process of supplying the same digital image signal.

There is a method in which a digital image signal of a static image is once written into an external memory circuit, and then, the digital image signal is supplied to a liquid crystal display device from the external memory circuit every one frame. However, the external memory circuit and the driver circuit have to continuously operate in any case.

Particularly in mobile apparatuses, lower power consumption is greatly desired. Further, in the mobile apparatus, though it is mostly used in a static image mode, the external circuit, the driver circuit, and the like are continuously operated in a static image display as described above. Thus, this is an obstacle to the lower power consumption.

SUMMARY OF THE INVENTION

The present invention has been made in view of the above, and an object of the present invention is therefore to reduce power consumption of an external circuit, a signal line driver circuit, and the like in displaying a static image by using a novel circuit.

In order to solve the above object, the present invention uses the following means.

One pixel has memory circuits for storing respective bits of a digital image signal and a D/A converter, and the digital image signal input from a source signal line is once held in the memory circuits and D/A-converted to thereby drive a liquid crystal. In case of a static image, information written into a pixel is the same after the digital image signal is once stored in the memory circuit. Therefore, without renewal of the digital image signal every one frame, the digital image signal stored in the memory circuit is read out to enable a display of the static image. That is, while the static image display is performed, after the process operation of the digital image signal for one frame, the digital image signal stored in the memory circuit is processed by the D/A converter in the pixel to perform write into the pixel. Thus, during this period, the display can be performed while the most parts of the driver circuit are stopped. As a result, this contributes to a sharp reduction in power consumption. In a liquid crystal display device using the present invention, it becomes possible to reduce the power consumption by approximately 100 mW in prior art to approximately 10 mW.

Hereinafter, structures of a display device of the present invention are described.

According to a first aspect of the present invention, there is provided a liquid crystal display device having a source signal line driver circuit, a gate signal line driver circuit, a DAC controller, and a pixel portion, the liquid crystal display device performing an image display using an n-bit (n is a natural number, n≧2) digital image signal, characterized in that:

one pixel in the pixel portion has 1 bit×n memory circuits for storing the n-bit digital image signal and a D/A converter.

According to a second aspect of the present invention, there is provided a liquid crystal display device having a source signal line driver circuit, a gate signal line driver circuit, a DAC controller, and a pixel portion, the liquid crystal display device performing an image display using an n-bit (n is a natural number, n≧2) digital image signal, characterized in that:

one pixel in the pixel portion has 1 bit×n memory circuits for storing the n-bit digital image signal and a D/A converter; and the memory circuits store the n-bit digital image signal for one frame.

According to a third aspect of the present invention, there is provided a liquid crystal display device having a source signal line driver circuit, a gate signal line driver circuit, a DAC controller, and a pixel portion, the liquid crystal display device performing an image display using an n-bit (n is a natural number, n≧2) digital image signal, characterized in that:

one pixel in the pixel portion has 1 bit×n memory circuits for storing the n-bit digital image signal and a D/A converter; and the liquid crystal display device has:

means for outputting a sampling pulse in accordance with a clock signal and a start pulse;

means for holding the digital image signal in accordance with the sampling pulse;

means for storing the held digital image signal;

means for reading out the stored digital image signal and conducting D/A conversion to obtain an analog gradation signal; and means for performing the image display in accordance with the analog gradation signal.

According to a fourth aspect of the present invention, the liquid crystal display device of any of the first to third aspects of the present invention is characterized in that the source signal line driver circuit sequentially inputs a digital image signal bit by bit.

According to a fifth aspect of the present invention, the liquid crystal display device of any of the first to third aspects of the present invention is characterized in that the gate signal line driver circuit sequentially drives the memory circuits in one pixel bit by bit through gate signal lines in one horizontal period.

According to a sixth aspect of the present invention, the liquid crystal display device of any of the first to third aspects of the present invention is characterized in that the DAC controller is input with a plurality of fixed electric potentials (voltages) and selects one or more of the plurality of fixed electric potentials (voltages) to supply them to a pixel.

According to a seventh aspect of the present invention, the liquid crystal display device of the sixth aspect of the present invention is characterized in that the DAC controller has a plurality of latch circuits and selects one or more of the plurality of fixed electric potentials (voltages) in accordance with selection information stored in the latch circuits.

According to an eighth aspect of the present invention, the liquid crystal display device of the seventh aspect of the present invention is characterized in that the selection information is rewritten every constant period.

According to a ninth aspect of the present invention, the liquid crystal display device of any of the first to third aspects of the present invention is characterized in that the memory circuit is a static type memory (SRAM).

According to a tenth aspect of the present invention, the liquid crystal display device of any of the first to third aspects of the present invention is characterized in that the source signal line driver circuit, the gate signal line driver circuit, and the DAC controller are formed on the same substrate as the pixel portion.

According to an eleventh aspect of the present invention, the liquid crystal display device of any of the first to third aspects of the present invention is characterized in that the source signal line driver circuit, the gate signal line driver circuit, or the DAC controller is an external circuit.

According to a twelfth aspect of the present invention, the liquid crystal display device of any of the first to third aspects of the present invention is characterized in that:

in a display period of a static image, only the DAC controller is driven;

a digital image signal stored in the memory circuits is repeatedly read out, and D/A conversion is conducted to obtain an analog gradation signal;

the image display is conducted in accordance with the analog gradation signal; and thus the source signal line driver circuit and the gate signal line driver circuit are stopped.

According to a thirteenth aspect of the present invention, the liquid crystal display device of any of the first to third aspects of the present invention is characterized in that:

in a display period of a static image, only the DAC controller is driven;

a digital image signal stored in the memory circuits is repeatedly read out, and D/A conversion is conducted to obtain an analog gradation signal;

the image display is conducted in accordance with the analog gradation signal; and thus an external circuit not including the DAC controller is stopped.

According to a fourteenth aspect of the present invention, the liquid crystal display device of any of the first to third aspects of the present invention is characterized in that:

the source signal line driver circuit has an X-address decoder;

the gate signal line driver circuit has a Y-address decoder; and in the memory circuit, rewrite is possible in a pixel at arbitrary coordinates in a display region.

According to a fifteenth aspect of the present invention, the liquid crystal display device of any of the first to third aspects of the present invention is characterized in that the memory circuits are formed over a glass substrate.

According to a sixteenth aspect of the present invention, the liquid crystal display device of any of the first to third aspects of the present invention is characterized in that the memory circuits are formed over a plastic substrate.

According to a seventeenth aspect of the present invention, the liquid crystal display device of any of the first to third aspects of the present invention is characterized in that the memory circuits are formed over a stainless substrate.

According to an eighteenth aspect of the present invention, the liquid crystal display device of any of the first to third aspects of the present invention is characterized in that the memory circuits are formed over a single crystal wafer.

DETAILED DESCRIPTION OF THE PREFERRED EMBODIMENTS

An embodiment mode of the present invention is described. Note that although a case where a gradation of a digital image signal is 3-bit is taken as an example for a concrete explanation, the present invention is not limited to 3-bit. The same method can be applied to an n-bit digital image signal.

Figure 1:
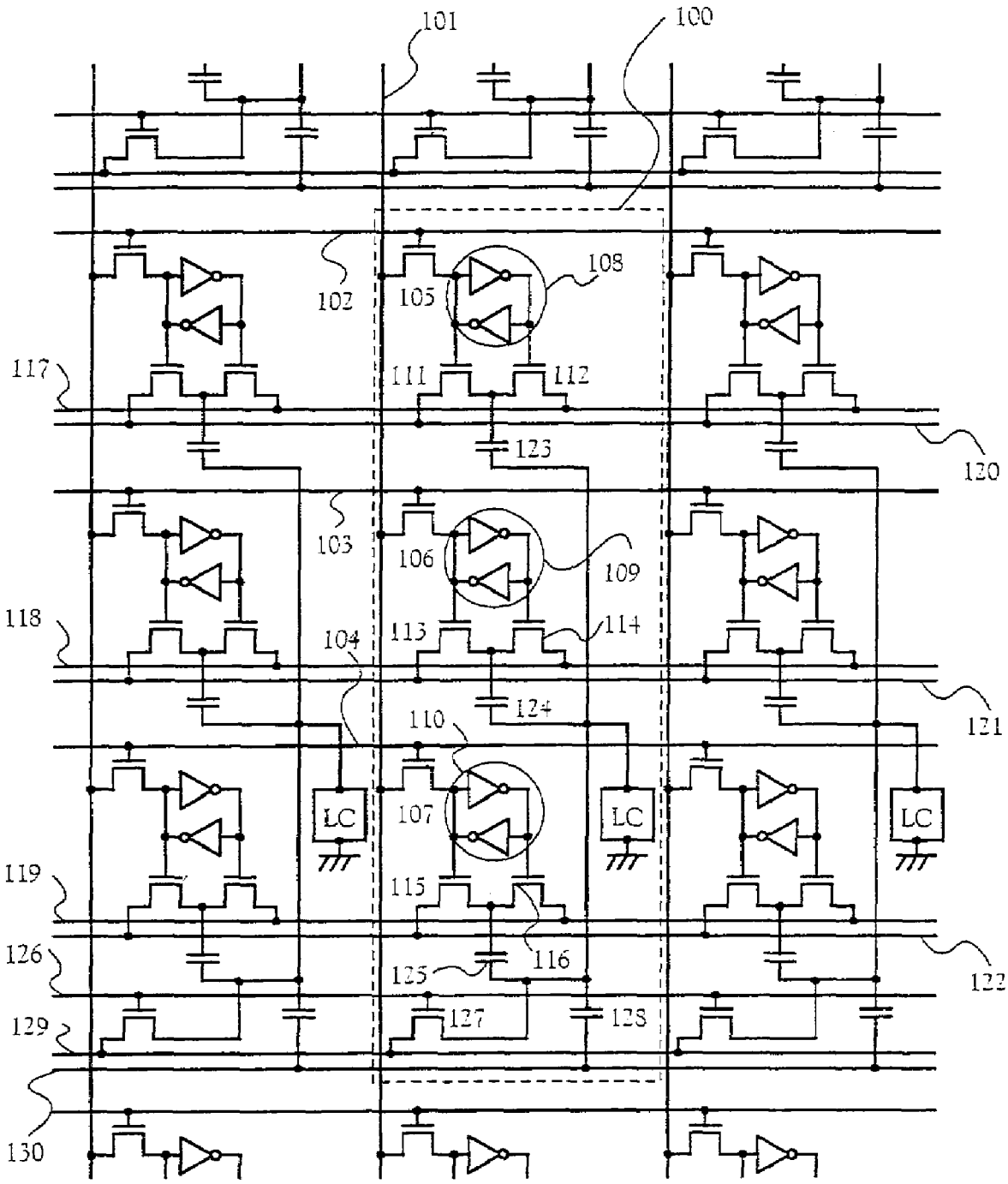
FIG. 1 is a circuit diagram of a pixel portion of a liquid crystal display device of the present invention.

FIG. 1 is a circuit diagram of a pixel portion of a display device of the present invention. A portion surrounded by a dotted line frame 100 corresponds to one pixel, and adjacent three pixels have color filters of R, G and B, respectively to perform a color image display. The one pixel has a source signal line 101, a first gate signal line 102, a second gate signal line 103, a third gate signal line 104, a first pixel TFT 105, a second pixel TFT 106, a third pixel TFT 107, a first memory circuit 108, a second memory circuit 109, a third memory circuit 110, gradation power source selection TFTs 111 to 116, low voltage side gradation power source lines ($V_L$) 117 to 119, high voltage side gradation power source lines ($V_H$) 120 to 122, a first DAC capacitor 123, a second DAC capacitor 124, a third DAC capacitor 125, a pixel portion reset signal line 126, a pixel portion reset TFT 127, a storage capacitor 128, a halftone gradation power source line ($V_M$) 129, a common power source line 130, and a liquid crystal element (LC). Operation of the respective portions is described later.

Here, when the DAC capacitors 123 to 125 are represented by $C_{123}$ to $C_{125}$, the capacity ratio is set to 4:2:1. The capacity to be charged is determined by a 3-bit digital image signal, and electric charges in 8 levels is charged in accordance with the combination of the capacity. Thus, a control of a voltage applied to the liquid crystal element is conducted.

Figure 2:
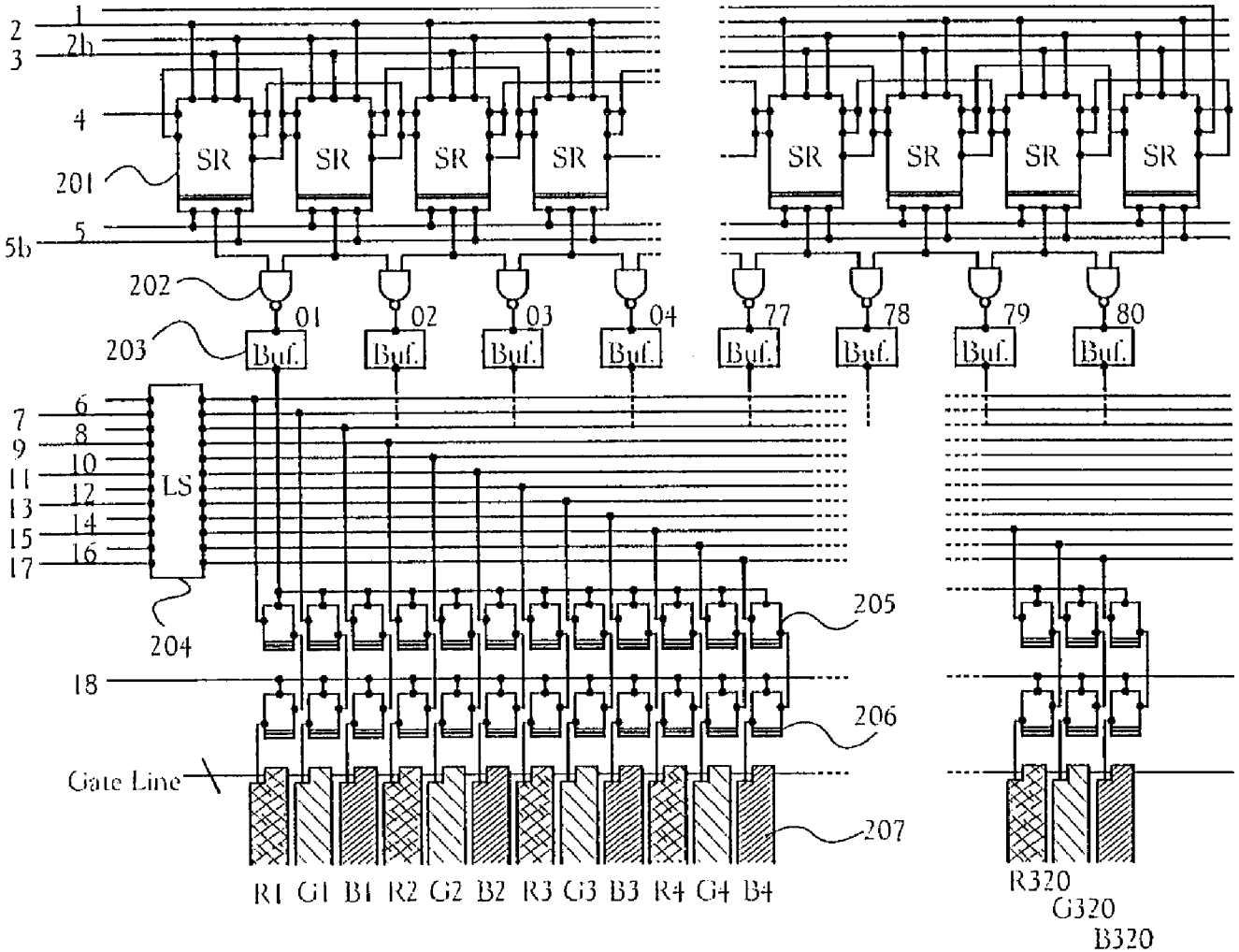
FIG. 2 is a circuit diagram of a source signal line driver circuit of the liquid crystal display device of the present invention.

FIG. 2 is a circuit diagram of a source signal line driver circuit of the display device of the present invention. Here, a display device of color QVGA is taken as an example, and the number of pixels in a horizontal direction is 960 pixels (320× RGB).

The source signal line driver circuit shown in the figure has a shift register 201, a NAND circuit 202, a buffer 203, a level shifter 204, a first latch circuit 205, a second latch circuit 206, a pixel 207, and the like. In addition, reference numeral 1 indicates a start pulse (R→L) (S-SP); 2, a clock signal (S-CLK); 2*b*, a clock signal (inversion) (S-CLKb); 3, an initial reset signal (S-Ini-Re); 4, a start pulse (L→R); 5, a scanning direction switching signal (LR); 5*b*, a scanning direction switching signal (inversion) (LRb); 6, a digital image signal red first phase (Data-R1); 7, a digital image signal green first phase (Data-G1); 8, a digital image signal blue first phase (Data-B1); 9, a digital image signal red second phase (Data-R2); 10, a digital image signal green second phase (Data-G2); 11, a digital image signal blue first phase (Data-B2); 12, a digital image signal red third phase (Data-R3); 13, a digital image signal green third phase (Data-G3); 14, a digital image signal blue third phase (Data-B3); 15, a digital image signal red fourth phase (Data-R4); 16, a digital image signal green fourth phase (Data-G4); 17, a digital image signal blue fourth phase (Data-B4); and 18, a latch pulse (S-LAT).

Figure 5A:
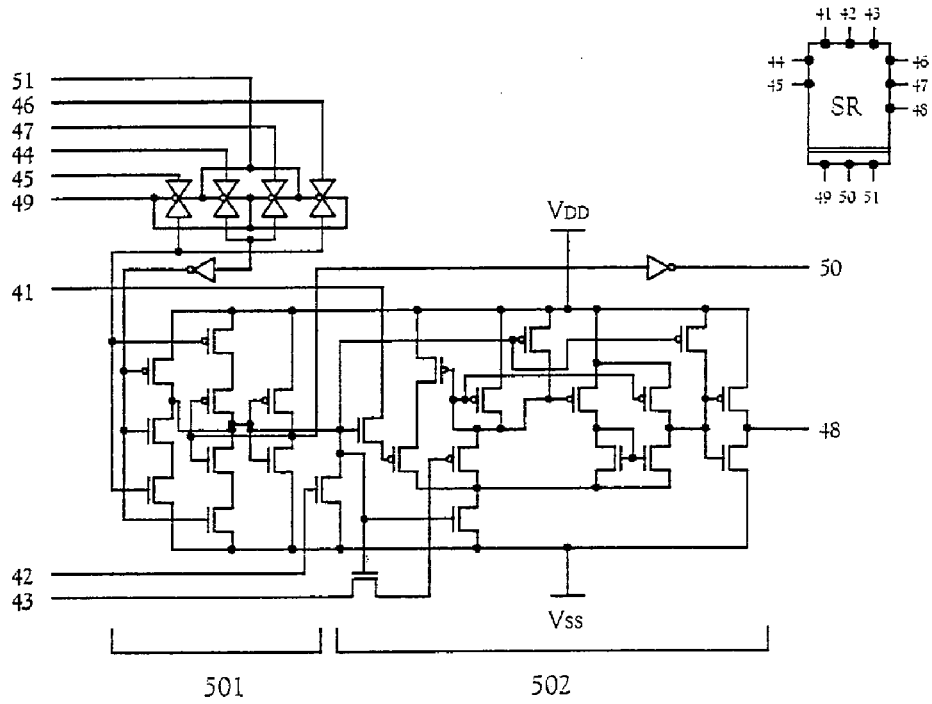
FIGS. 5A and 5B are detailed diagrams of the circuits indicated by blocks in the respective circuit diagrams of the present invention.

The shift register 201 has the structure shown in FIG. 5A. In FIG. 5A, reference numerals 41 to 51 attached to inputs/outputs of respective signals correspond to reference numerals 41 to 51 attached to input/output pins of a block diagram of the same figure. The shift register used here has a shift register portion 501 for sequentially outputting sampling pulses and a level shifter portion 502 using a differential amplifier circuit.

As for the NAND circuit 202 and the buffer 203, general ones may be used, and thus, the explanation thereof is omitted here.

Figure 5B:
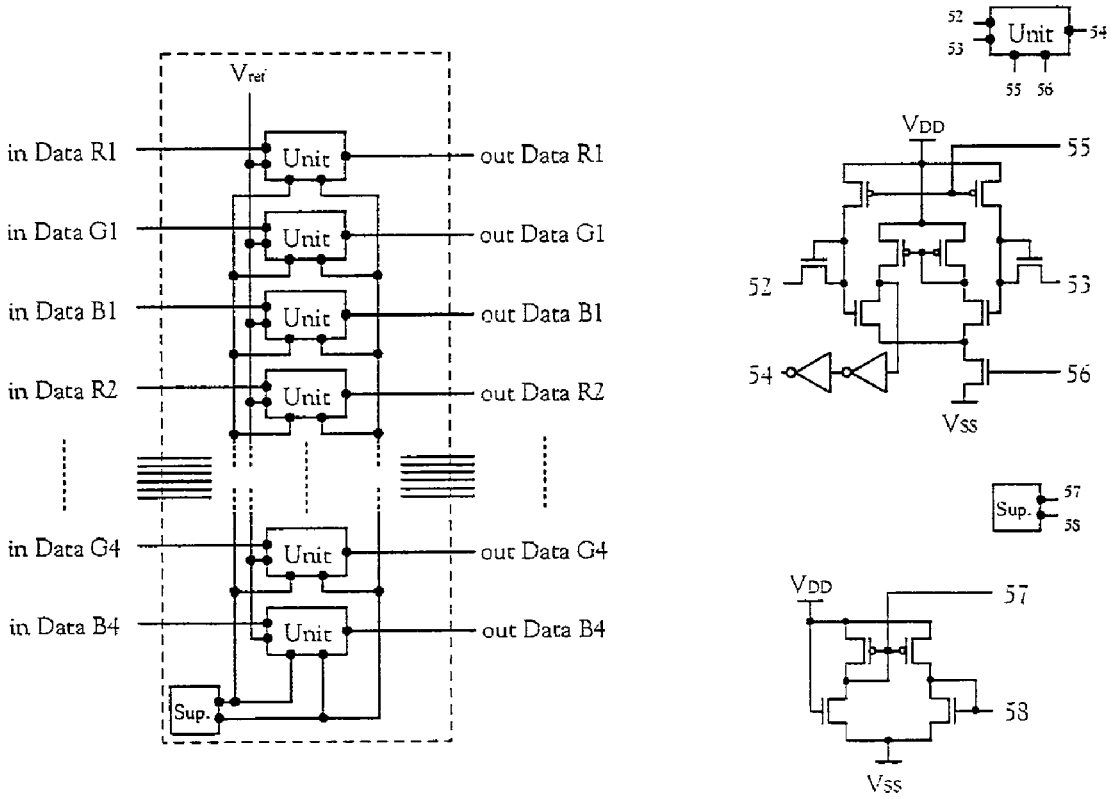

The level shifter 204 performs conversion of a voltage amplitude of a digital image signal supplied from an external source. The level shifter 204 has the structure shown in FIG. 5B, and has 12 level shifter circuits (indicated by Unit in a block diagram of FIG. 5B) and a current source (indicated by Sup. in the block diagram of FIG. 5B). Circuit diagrams of the level shifter circuit and the current source are also shown in FIG. 5B. Digital image signals input from twelve signal lines (RGB×4 phases) are subjected to the conversion of a voltage amplitude by the respective level shifters and output to video signal lines.

Figure 6A:
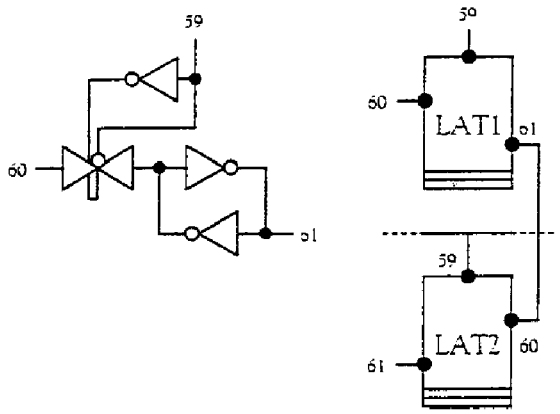
FIGS. 6A to 6C are detailed diagrams of the circuits indicated by blocks in the respective circuit diagrams of the present invention.

The first latch circuit 205 and the second latch circuit 206 have the structures shown in FIG. 6A. Reference numerals 59 to 61 attached to outputs/inputs of respective signals correspond to reference numerals 59 to 61 attached to input/output pins of a block diagram of the same figure.

Figure 7:
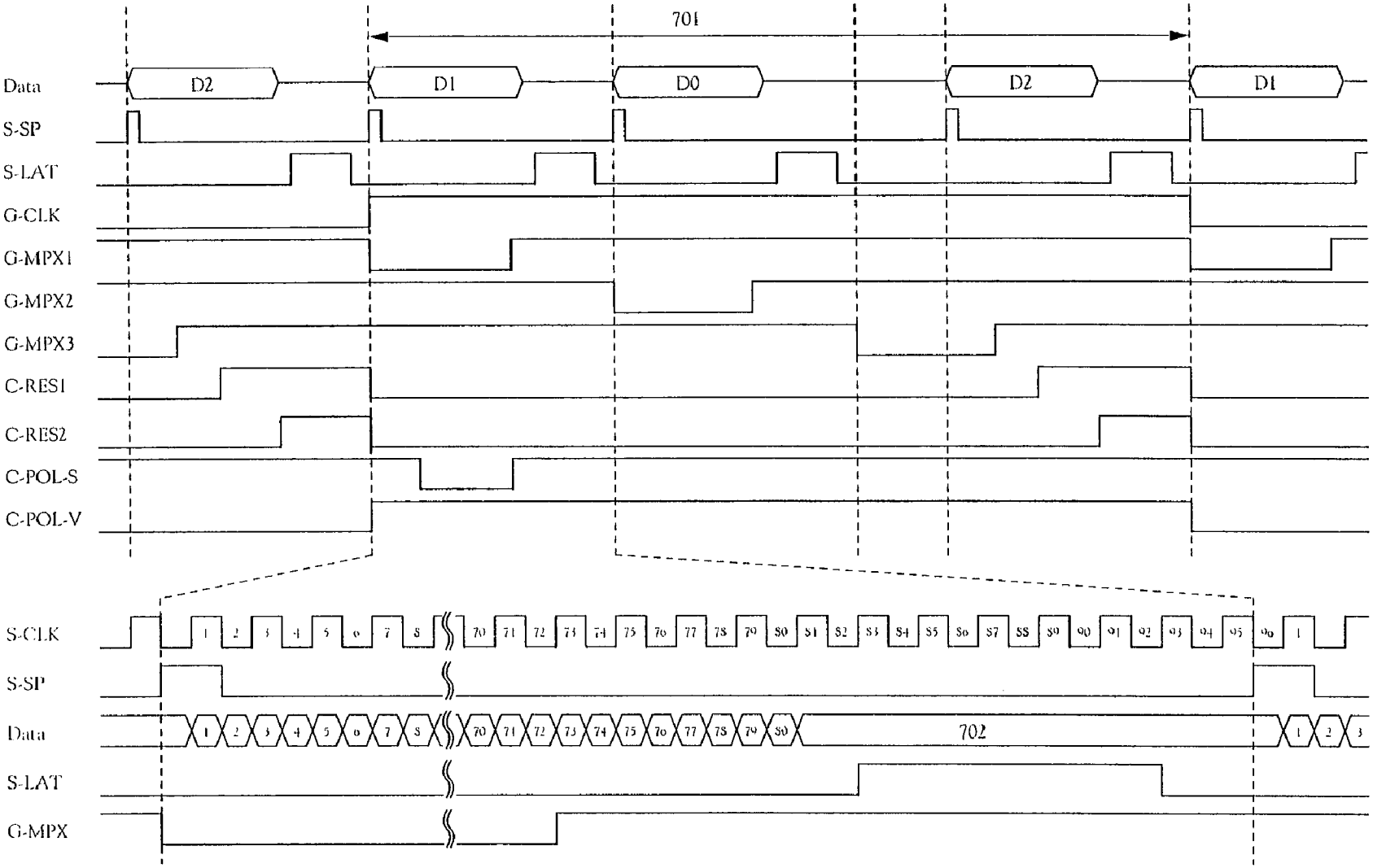
FIG. 7 is a diagram showing a timing chart about operation of the liquid crystal display device of the present invention.

The operation of the source signal line driver circuit is explained. FIG. 7 is a timing chart, which is referred for the explanation. Note that FIG. 2 described above is referred for the circuit diagram. Reference numeral 701 indicates one horizontal period; 702, a return line period. The shift register 201 outputs sampling pulses sequentially by input of start pulses (S-SP) and clock signals (S-CLK). Thereafter, the sampling pulses pass through the NAND circuit 202 and the buffer 203, and become pulses for conducting a latch operation in the first latch circuit 205. In the first latch circuit 205, digital image signals are sequentially latched in accordance with the timing of the sampling pulse. Since the source signal line driver circuit shown in FIG. 2 applies three colors of RGB and video 4-divisions, the first latch circuit 205 of twelve stages simultaneously performs the latch operation with the timing of one sampling pulse. After the completion of the latch operation of one row in a horizontal direction, a latch pulse (S-LAT) is input in a return line period, and in accordance with the timing, the digital image signals are transferred to the second latch circuit 206 from the first latch circuit 205. Note that the shift register 201 through the second latch circuit 206 in FIG. 2 perform the above operation three times in one horizontal period to sequentially process the 3-bit digital image signals.

The source signal line driver circuit in the liquid crystal display device of the present invention has a structure in which data every bit is sequentially input as shown in FIG. 7. Here, the input of data is conducted in the order of D2, D1 and D0. With this structure, it is possible to reduce the number of latch circuits in the source signal line driver circuit.

Figure 3:
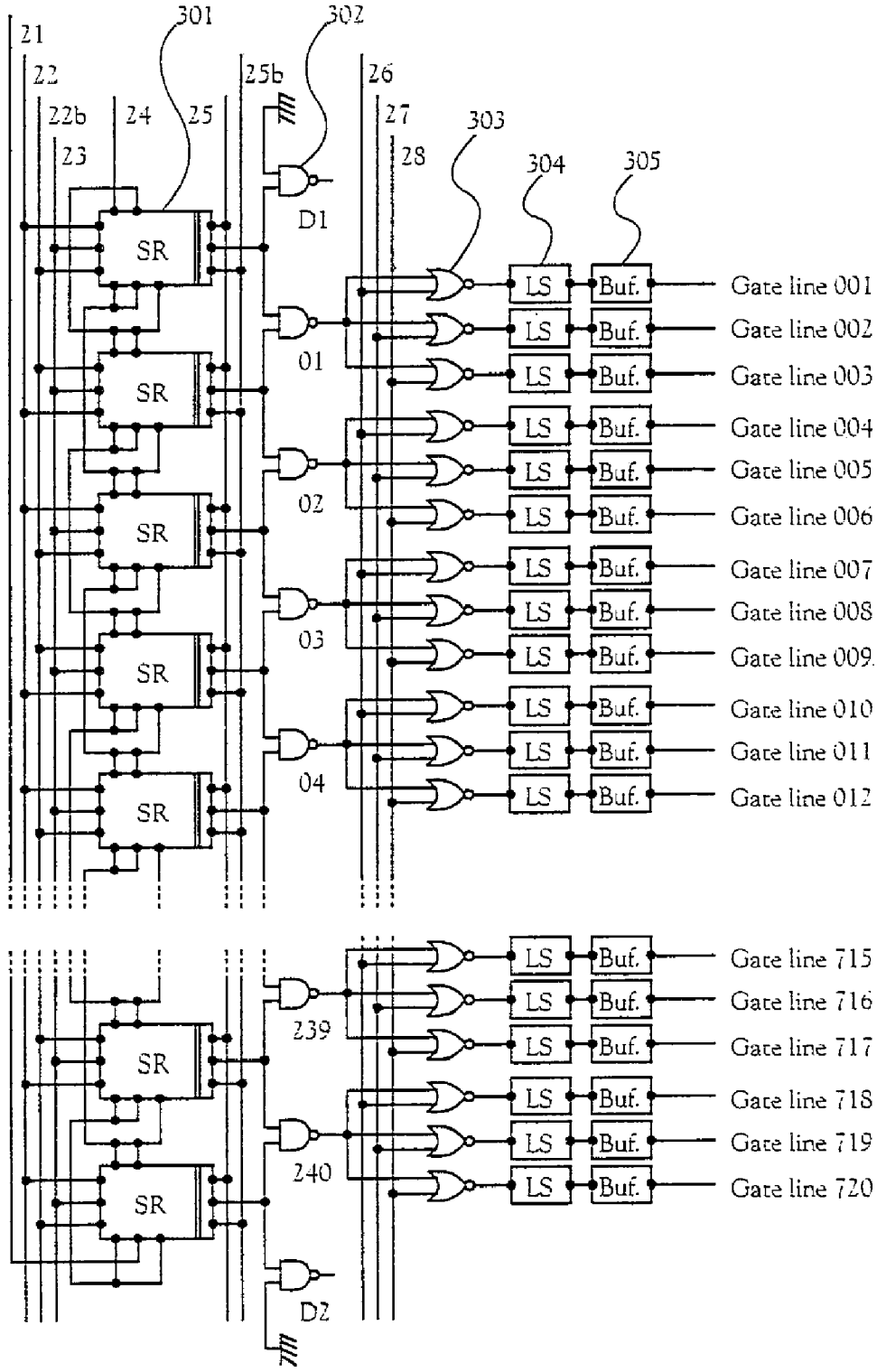
FIG. 3 is a circuit diagram of a gate signal line driver circuit of the liquid crystal display device of the present invention.

FIG. 3 is a circuit diagram of a gate signal line driver circuit of the display device of the present invention. Here, the display device of color QVGA is taken as an example, and the number of pixels in a vertical direction is 240 pixels. Note that, in the liquid crystal display device of the present invention, in the case where a gradation of a digital image signal is 3-bit, one pixel is controlled by using three gate signal lines. Thus, in FIG. 3, the number of gate signal lines is 240×3=720. That is, in order to realize n-bit digital gradation according to the present invention, n-gate signal lines are used per one pixel, and the number of gate signal lines may be 240×n in case of FIG. 3.

The gate signal line driver circuit shown in the figure has a shift register 301, a NAND circuit 302, a multiplexer 303 using a NOR circuit, a level shifter 304, a buffer 305, and the like. In addition, reference numeral 21 indicates a start pulse (D→U) (G-SP); 22, a clock signal (G-CLK); 22*b*, a clock signal (inversion) (G-CLKb); 23, an initial reset signal (G-Ini-Re); 24, a start pulse (U→D) (G-SP); 25, a scanning direction switching signal (UD); 25*b*, a scanning direction switching signal (inversion) (UDb); 26, a multiplexer signal 1 (GMPX1); 27, a multiplexer signal 2 (GMPX2); and 28, a multiplexer signal 3 (GMPX3).

The shift register 301 is identical with the circuit shown in FIG. 5A in the heading of the source signal line driver circuit, and thus, the explanation is omitted.

Figure 6B:
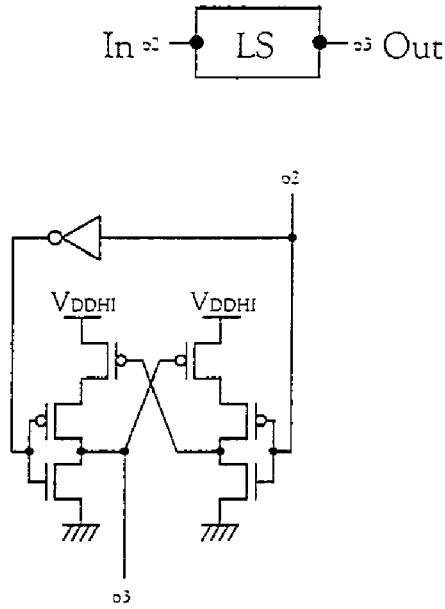

The level shifter 304 has the structure as shown in FIG. 6B. In FIG. 6B, reference numerals 62 and 63 attached to inputs/outputs of respective signals correspond to reference numerals 62 and 63 attached to input/output pins of a block diagram of the same figure.

As for the NAND circuit 302 and the buffer 305, general ones may be used, and thus, the explanation thereof is omitted here.

Figure 8:
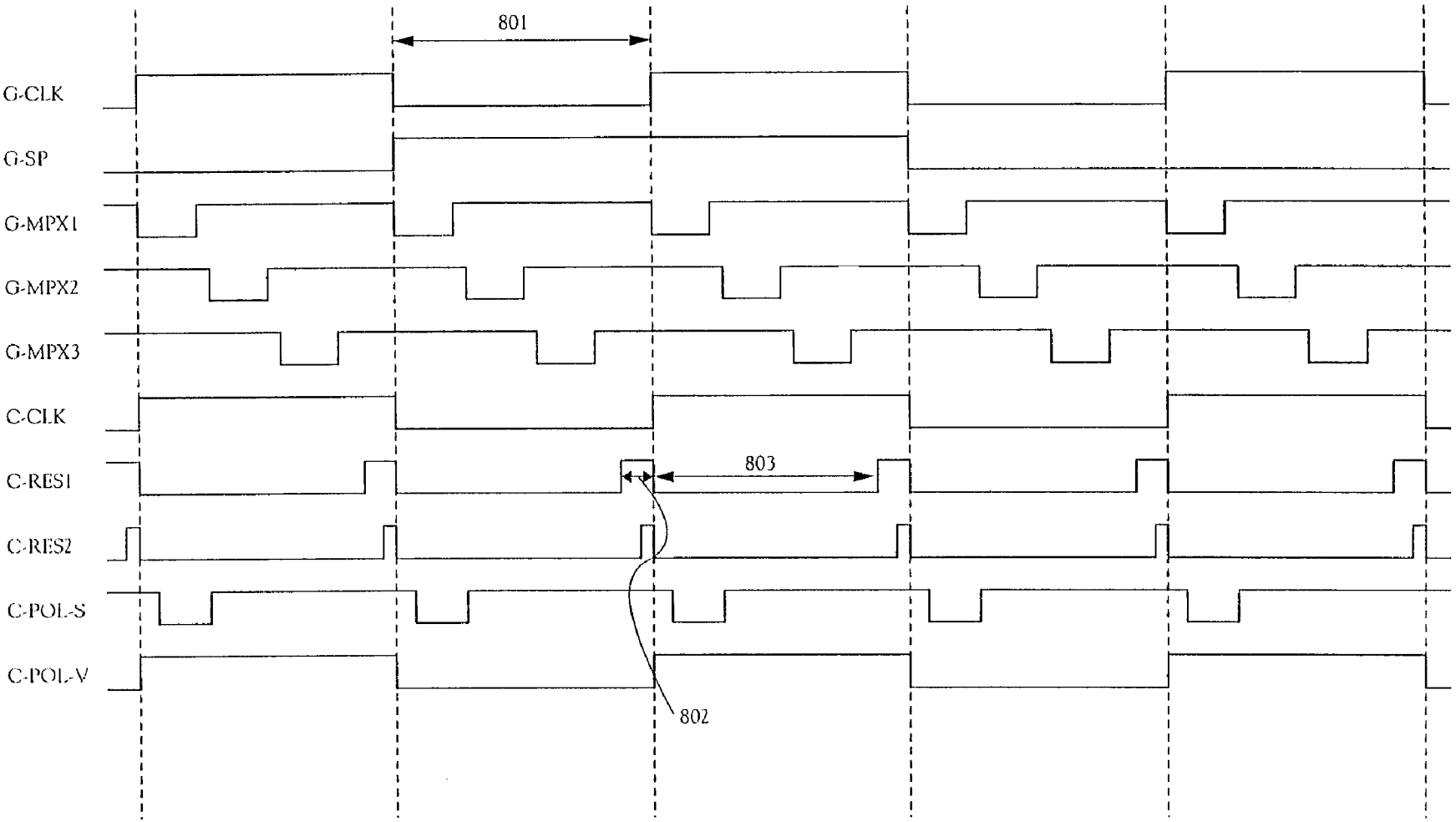
FIG. 8 is a diagram showing a timing chart about operation of the liquid crystal display device of the present invention.

Next, the operation of the gate signal line driver circuit is explained. In FIG. 8, a timing chart is shown. The timing chart is referred for the explanation. Reference numeral 801 indicates one horizontal period; 802, a DAC processing period; and 803, a display period. Note that FIG. 3 described above is referred for the circuit diagram. The shift register 301 sequentially outputs selection pulses by input of start pulses (G-SP) and clock signals (G-CLK). Thereafter, the selection pulses pass through the NAND circuit 302 and are input to the multiplexer 303. The multiplexer 303 is input with first to third multiplex signals (G-MPX1 to 3) together and sequentially outputs three selection pulses having a pulse width that is one third as wide as a pulse output from the shift register. These are output to the gate signal line as gate signal line selection pulses, and a voltage is applied to a gate electrode of a pixel TFT.

Figure 4:
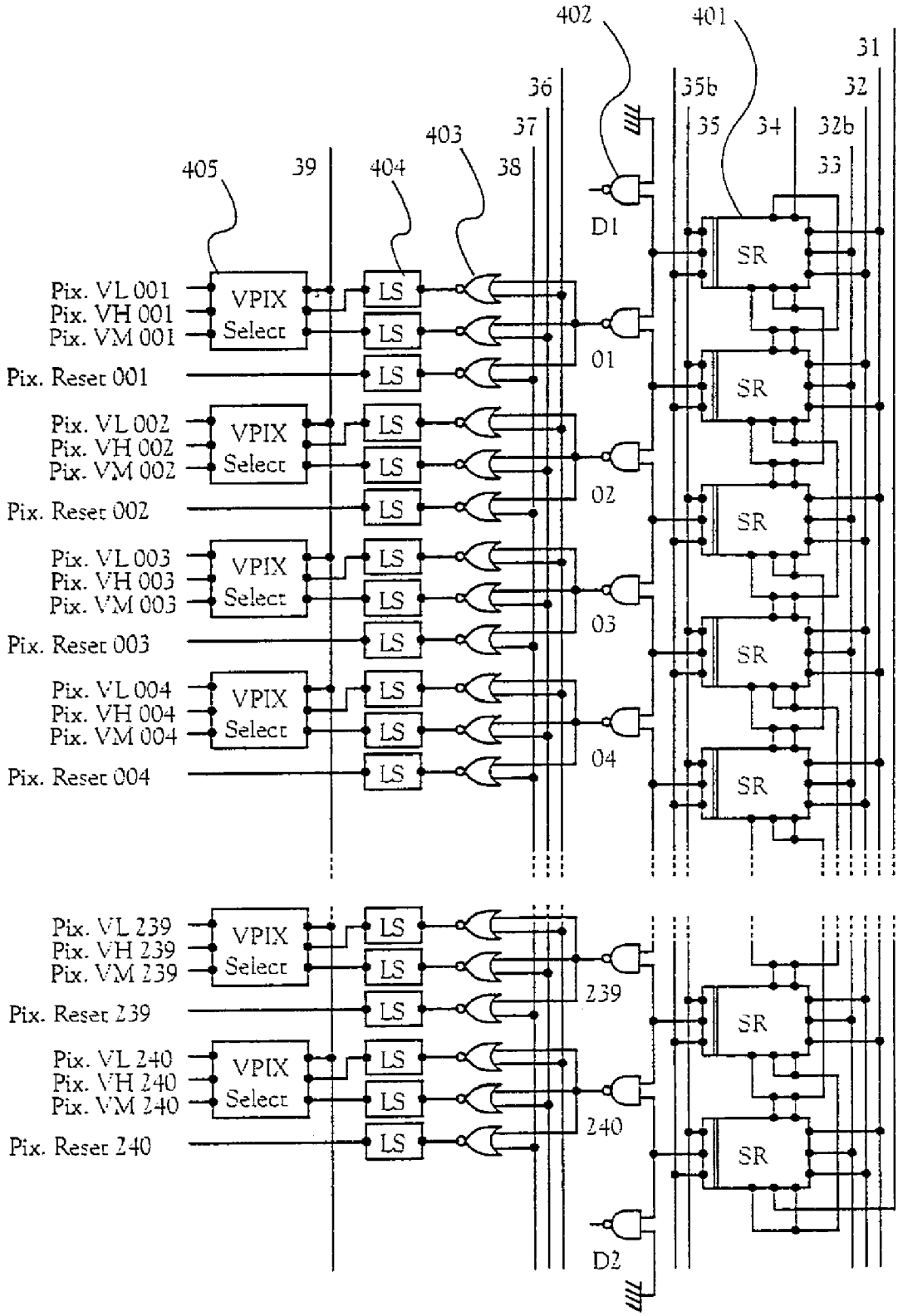
FIG. 4 is a circuit diagram of a DAC controller of the liquid crystal display device of the present invention.

FIG. 4 is a circuit diagram of a DAC controller of the display device of the present invention. The DAC controller shown in the figure has a shift register 401, a NAND circuit 402, a multiplexer 403 using a NOR circuit, a level shifter 404, a gradation power source selection circuit ($V_{PIX}$ Select) 405, and the like. Note, reference numeral 31 indicates a start pulse (D→U) (C-SP); 32, a clock signal (C-CLK); 32*b*, a clock signal (inversion) (C-CLKb); 33, an initial reset signal (C-Ini-Re); 34, a start pulse (U→D) (C-SP); 35, a scanning direction switching signal (UD); 35*b*, a scanning direction switching signal (inversion) (UDb); 36, a polarity inversion signal (C-Pol-S); 37, a reset signal 2 (C-Res-2); 38, a reset signal 1 (C-Res-1); 39, a polarity switching signal (C-Pol-V).

Here, the circuits of the shift register 401 through the level shifter 404 are identical with those of the gate signal line driver circuit described using FIG. 3, and thus, the explanation thereof is omitted here.

Figure 6C:
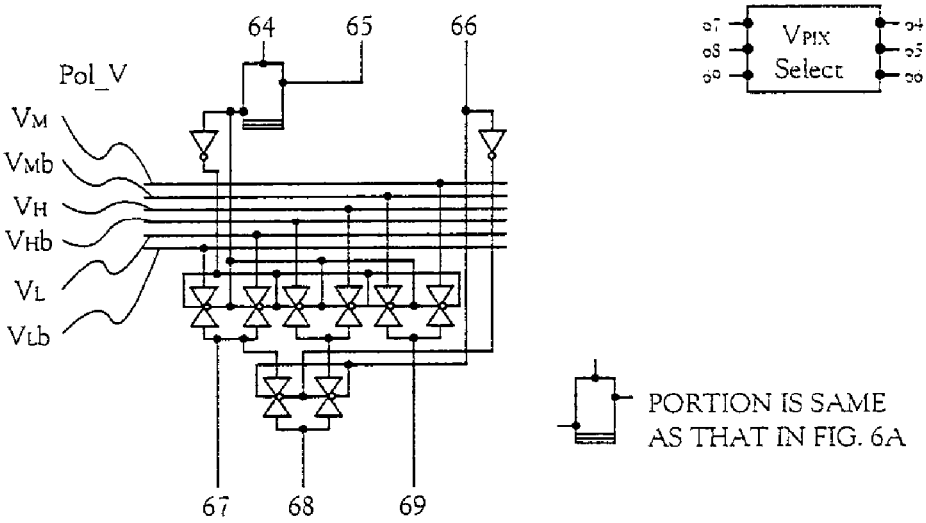

The gradation power source selection circuit 405 has the structure shown in FIG. 6C. In FIG. 6C, reference numerals 64 to 68 attached to inputs/outputs of respective signals correspond to reference numerals 64 to 68 attached to input/output pins of a block diagram of the same figure.

Subsequently, the operation of the DAC controller is explained. FIG. 8 is a timing chart which is referred for the explanation. Note that FIG. 4 described above is referred for the circuit diagram. The operation of the shift register 401 through the NAND circuit 402 is the same as the gate signal line driver circuit. The multiplexer 403 is input with a polarity inversion signal (C-Pol-S), a reset signal 1 (C-Res1), and a reset signal 2 (C-Res2) to obtain a logical sum with a selection pulse output from the shift register 401. Among these signals, the reset signal 1 is subjected to the conversion of a voltage amplitude in the level shifter 404 and directly output to a reset signal line of a pixel portion. The reset signal 2 and the polarity inversion signal are subjected to the conversion of a voltage amplitude in the level shifter 404 and then, input to the gradation power source selection circuit 405.

Here, the operation of the gradation power source selection circuit 405 is described. The gradation power source selection circuit 405 is input with a polarity switching signal (C-Pol-V) in addition to the above-described two signals. This signal is one for switching positive and negative of a voltage applied to the liquid crystal element every constant period (normally, every one frame period). When the gradation power source selection circuit 405 is input with the polarity inversion signal (C-Pol-S), the state of the polarity switching signal (C-Pol-V) at this time is latched. Thereafter, until the polarity inversion signal (C-Pot-S) is input again, the state controls a group of analog switches (see a detailed diagram of FIG. 6C) in the gradation power source selection circuit 405. Here, positive or negative of an electric potential applied to a pixel is determined.

Either $V_H$ or $V_{Hb}$, is selected as the high voltage side gradation power supply line, and either $V_L$ or $V_{Lb}$ is selected as the low voltage side gradation power source line. At this time, when an electric potential (voltage) of an opposing electrode of the liquid crystal is indicated as COM and $V_H>V_M>V_L$, $|V_H-V_M|\approx|V_{Hb}-V_M|$, $|V_L-V_M|\approx|V_{Lb}-V_M|$.

For example, if $V_M=0V$, $V_H=-V_L=5V$, and $V_{Hb}=-V_{Lb}=-5V$, this satisfies the above conditions, and also is simple and desirable.

Further, while the reset signal 2 is being input, the same potential as the low voltage side gradation power source line is forcedly input to the high voltage side gradation power source line ($V_H$) (that is, $V_H=V_L$ in FIG. 1). During writing operation for 3 bits to the memory circuits of the pixel portion, which will be described later, a charge is not stored in the DAC capacitors.

Subsequently, the operation of processing of signals in a pixel through displaying is explained. FIG. 1 described above is referred for the explanation. A 3-bit digital image signal is sequentially input every bit from the source signal line 101. The three gate signal lines 102 to 104 arranged in one pixel are sequentially selected in one horizontal period, whereby this digital image signal is written into the respective memory circuits.

First, the reset signal 1 (C-Rest) is input, the pixel portion reset TFT 127 is made conductive, and an electric potential of the opposing electrode is initialized to $V_M$. Next, the reset signal 2 (C-Res2) is input, and the state in which a charge is not stored in the DAC capacitors 123 to 125 is fixed.

Subsequently, one horizontal period is divided into three sub-periods. In the first sub-period, the first gate signal line 102 is selected at the timing of the first multiplex signal (G-MPX1) to make the first pixel TFT 105 conductive, and then, a digital image signal (D2) of the most significant bit is written into the memory circuit 108. Thereafter, the second gate signal line 103 is selected at the timing of the second multiplex signal (G-MPX2) to make the second pixel TFT 106 conductive, and then, a digital image signal (D1) of the second bit is written into the memory circuit 109. Finally, the third gate signal line 104 is selected at the timing of the third multiplex signal (G-MPX3) to make the third pixel TFT 107 conductive, and then, a digital image signal (D0) of the least significant bit is written into the memory circuit 110.

The gradation power source lines are selected for respective bits by the gradation power source selection TFTs 111 to 116 in accordance with the digital image signals stored in the memory circuits 108 to 110. At this time, the pulse of the reset signal 2 (C-Res2) stops, charges are stored in the DAC capacitors 123 to 125, and the liquid crystal element is driven to perform an image display.

In order to make the liquid crystal display device of the present invention compatible with an n-bit digital image signal, it is appropriate that one horizontal period is divided into n and the same process is conducted. Thereafter, the write of signals to the memory circuit can be conducted bit by bit.

In the case where a static image is displayed, the source signal line driver circuit and the gate signal line driver circuit are stopped, and only the DAC controller is operated. At this time, the digital image signal stored in the memory circuits is read out every frame, whereby the static image display can be continuously performed. Therefore, it is possible to drastically reduce the power consumption of the driver circuit in comparison with a conventional display device.

Note that a capacitor type D/A converter using a plurality of capacitors is used as a D/A converter in this embodiment mode, but a resistance type D/A converter that provides a plurality of electric potentials by resistance division, and the like may also be used.

Hereinafter, embodiments of the present invention are described.

Embodiment 1

Figure 12:
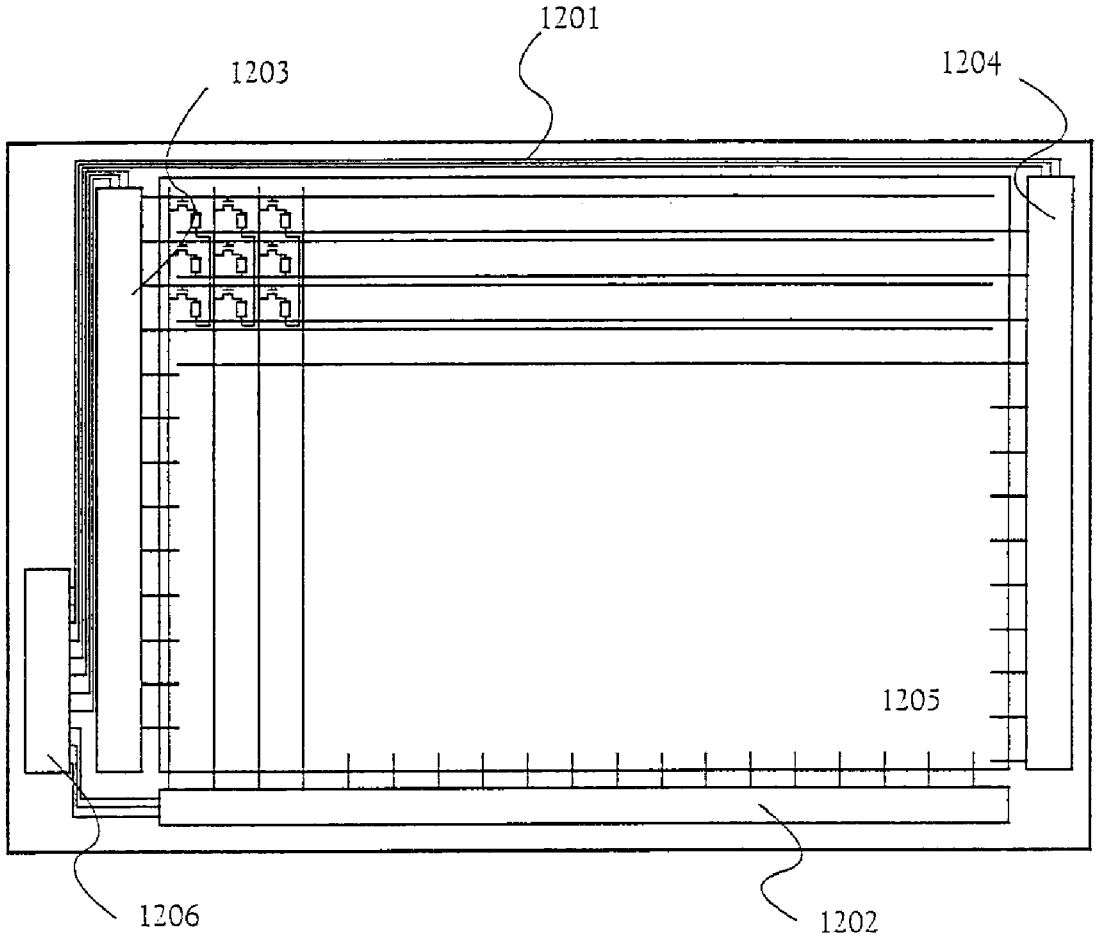
FIG. 12 is a schematic diagram of a whole substrate of a liquid crystal display device of Embodiment 1.
Figure 14A:
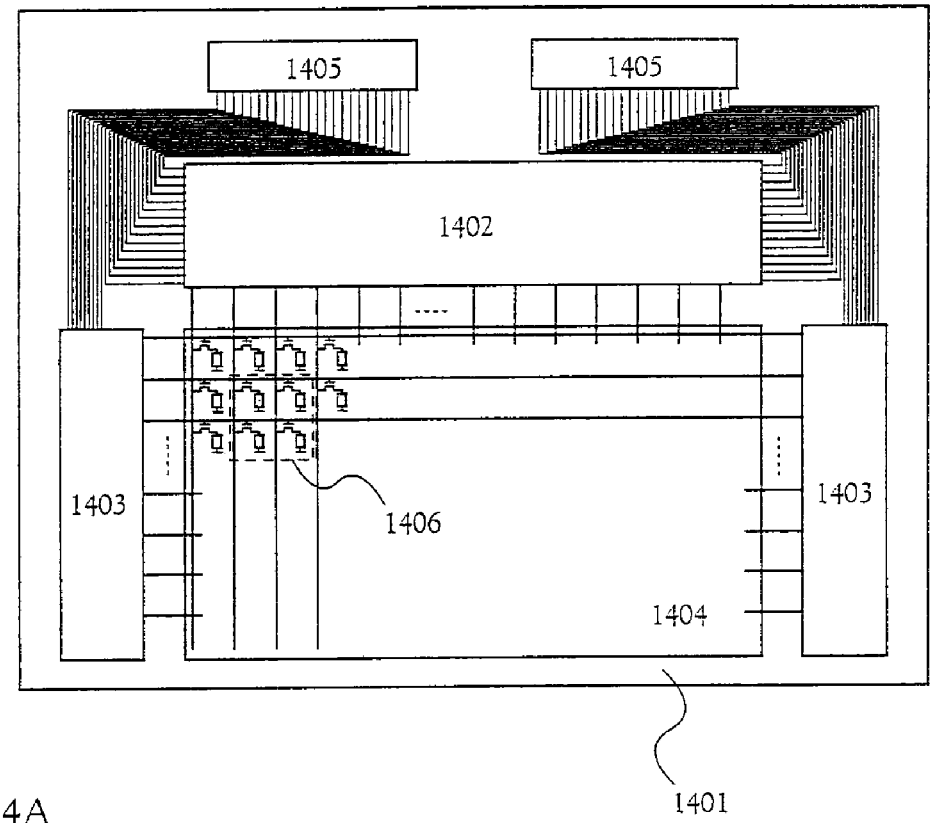
FIG. 14A PRIOR ART
FIGS. 14A and 14B are schematic diagrams of a whole substrate and a circuit diagram of a pixel portion of a conventional liquid crystal display device, respectively.
Figure 14B:
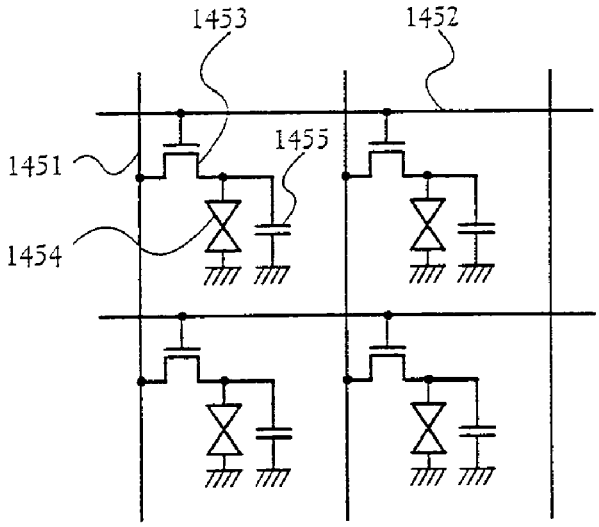
PRIOR ART FIG. 14B
Figure 15:
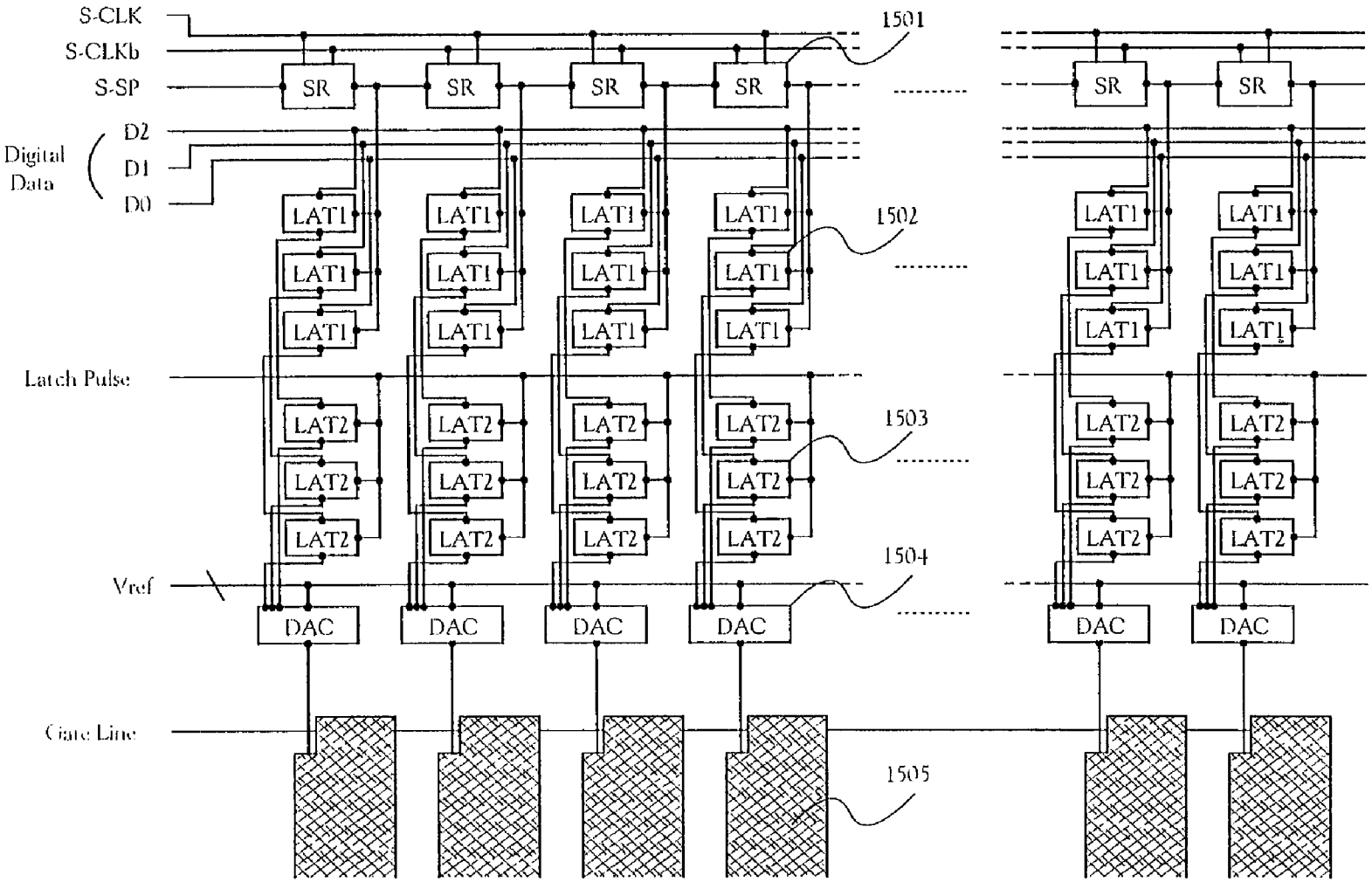
PRIOR ART FIG. 15
FIG. 15 is a circuit diagram of a source signal line driver circuit of the conventional liquid crystal display device.

FIG. 12 is an overall schematic diagram of a liquid crystal display device of the present invention. A pixel portion 1205 is provided in the center portion of a substrate 1201, and an FPC 1206 for inputting signals is provided in the end portion. A source signal line driver circuit 1202 is arranged under the pixel portion 1205, and processes digital image signals and performs write in a source signal line. On the right and left sides of the pixel portion 1205 are arranged a gate signal line driver circuit 1203 for selecting a gate signal line and a DAC controller 1204 for controlling a D/A converter arranged in the pixel portion. Taking the driving reliability, efficiency, and the like of the liquid crystal display device into consideration, the opposite arrangement of the driver circuits on both sides of the pixel portion is desirable as shown in FIG. 14A. However, the one side arrangement may be adopted as in this embodiment. Further, in order to take the arrangement on both sides with the circuit structure shown in FIG. 12, a method of forming the gate signal line driver circuit 1203 and the DAC controller 1204 as one circuit is given. In accordance with the operation of the driver circuit as shown above, since the gate signal line driver circuit 1203 and the DAC controller 1204 are driven by clock signals having the same frequency, it is easy to integrally form one circuit as described above. Thus, it can be said that the above-described method is an effective means.

Figure 9:
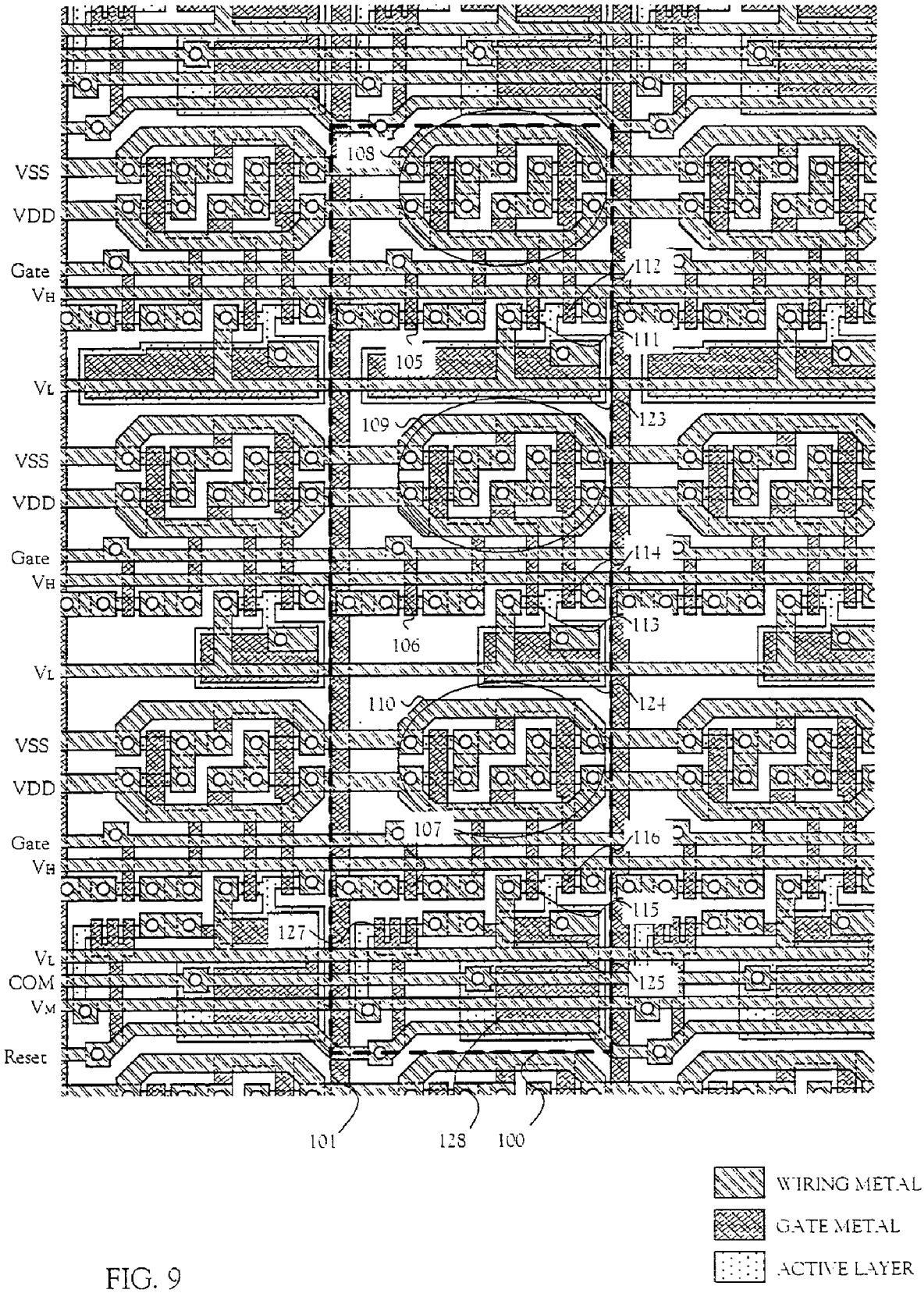
FIG. 9 is a diagram showing an actual layout of a pixel portion of a liquid crystal display device of Embodiment 1.

FIG. 9 shows an example of the circuit layout of the pixel portion of the active matrix substrate of the liquid crystal display device of the present invention. In FIG. 9, an opposing electrode arranged on the side of an opposing substrate, a pixel electrode, and the like are omitted. Note that reference numerals in the figure are the same as those in the circuit diagram of FIG. 1. Further, VDD indicates a positive power source line; VSS, a negative power source line; COM, a common power source line; $V_H$, a high voltage side gradation power source line; $V_L$, a low voltage side gradation power source line; $V_M$, a halftone gradation power source line; Gate, a gate signal line; and Reset, a reset signal line.

A portion surrounded by a dotted line frame 100 corresponds to one pixel. Portions surrounded by dotted line frames 108 to 110, respectively, correspond to memory circuits for storing a digital image signal every bit, and in the figure shown in this embodiment, the memory circuits are general SRAMs in which an inverter is connected in a loop shape. As described above, in the liquid crystal display device of the present invention, a number of elements are required for the circuit structure of the pixel portion in comparison with a general case, and thus, it is difficult to secure an opening ratio. Therefore, a reflection type structure of the pixel portion is desirably adopted for the liquid crystal display device of the present invention. However, if saving space in the respective portions is possible due to minute processing of the circuit, and the like, a transmission type liquid crystal display device may be easily applied.

Embodiment 2

In this embodiment, a method of simultaneously forming of TFTs of a pixel portion 5100 and of a driver circuit 5101 (source signal side driver circuit and gate signal side driver circuit) which is formed the periphery of the pixel portion of the display device of the present invention. However, to simplify of the explanation, concerning the driver circuit portion, CMOS circuit, which is a basic circuit, is illustrated.

Figures 16A, 16B, 16C:
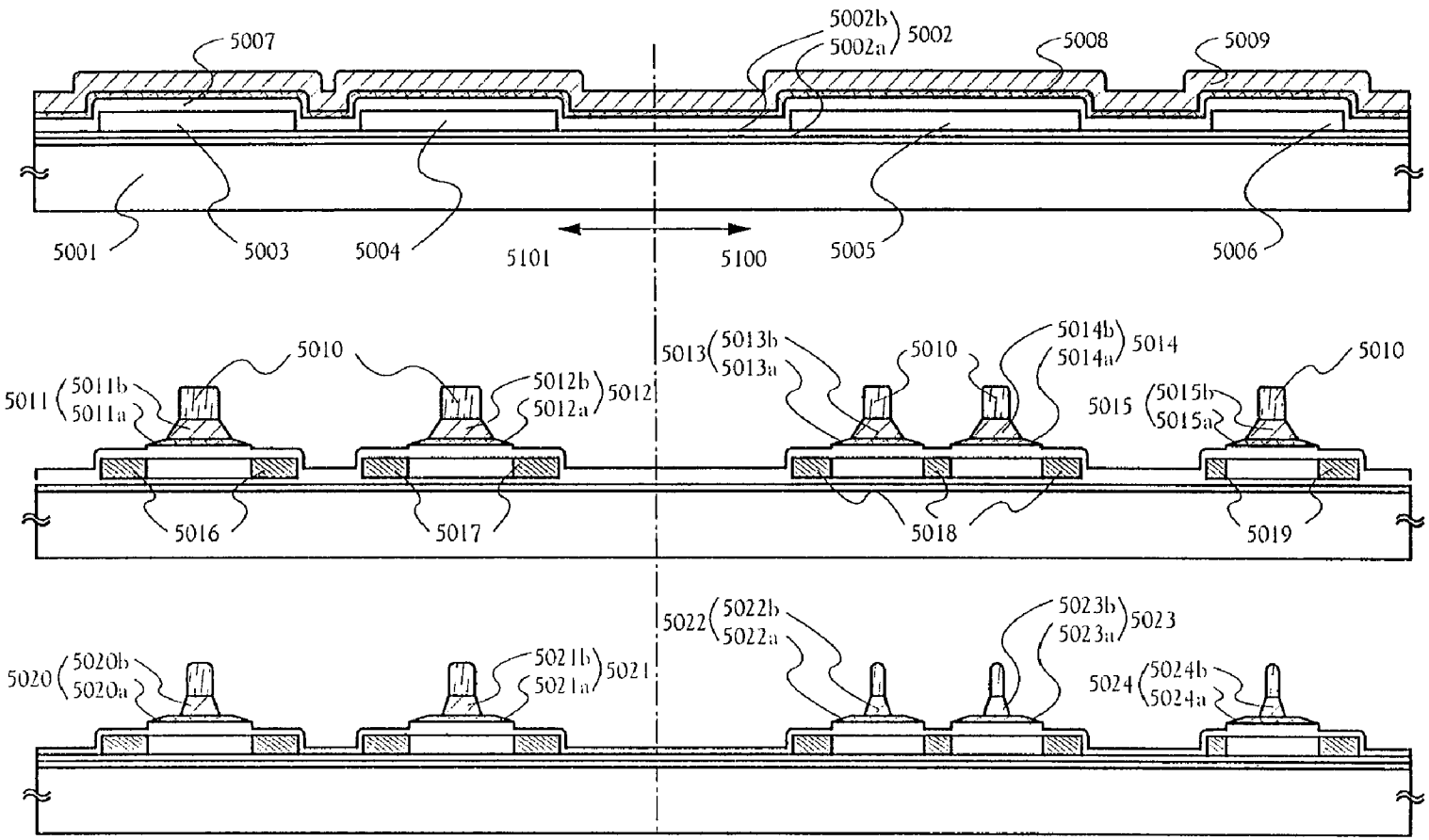
FIGS. 16A to 16C are diagrams showing examples of a manufacturing process of a liquid crystal display device of Embodiment 2.

FIG. 16A is referred. First, in this embodiment, a substrate 5001 is used, which is made of glass such as barium borosilicate glass or aluminum borosilicate, represented by such as Corning #7059 glass and #1737 glass. Note that, as the substrate 5001, there is no limitation provided that it is a substrate with transmittance, and a quartz substrate may be used. A plastic substrate with heat resistance to a process temperature of this embodiment may also be used.

Then, a base film 5002 formed of an insulating film such as a silicon oxide film, a silicon nitride film or a silicon nitride oxide film is formed on the substrate 5001. In this embodiment, a two-layer structure is used as the base film 5002. However, a single-layer film or a lamination structure consisting of two or more layers of the insulating film may be used. As a first layer of the base film 5002, a silicon nitride oxide film 5001*a* is formed with a thickness of 10 to 200 nm (preferably 50 to 100 nm) with a plasma CVD method using $SiH_4$, $NH_3$, and $N_2O$ as reaction gas. In this embodiment, the silicon nitride oxide film 5002*a* (composition ratio Si=32%, O=27%, N=24% and H=17%) with a film thickness of 50 nm is formed. Then, as a second layer of the base film 5002, a silicon nitride oxide film 5002*b* is formed and laminated into a thickness of 50 to 200 nm (preferably 100 to 150 nm) with a plasma CVD method using $SiH_4$, and $N_2O$ as reaction gas. In this embodiment, the silicon nitride oxide film 5002*b* (composition ratio Si=32%, O=59%, N=7% and H=2%) with a film thickness of 100 nm is formed.

Subsequently, semiconductor layers 5003 to 5006 are formed on the base film. The semiconductor layers 5003 to 5006 are formed from a semiconductor film with an amorphous structure which is formed by a known method (such as a sputtering method, an LPCVD method, or a plasma CVD method), and is subjected to a known crystallization process (a laser crystallization method, a thermal crystallization method, or a thermal crystallization method using a catalyst such as nickel). The crystalline semiconductor film thus obtained is patterned into desired shapes to obtain the semiconductor layers. The semiconductor layers 5003 to 5006 are formed into the thickness of from 25 to 80 nm (preferably 30 to 60 nm). The material of the crystalline semiconductor film is not particularly limited, but it is preferable to be formed of silicon, a silicon germanium ($Si_xGe_{1-x}$(X=0.0001 to 0.02)) alloy, or the like. In this embodiment, 55 nm thick amorphous silicon film is formed by a plasma CVD method, and then, a nickel-containing solution is held on the amorphous silicon film. A dehydrogenation process of the amorphous silicon film is performed (500° C. for one hour), and thereafter a thermal crystallization process is performed (550° C. for four hours) thereto. Further, to improve the crystallinity thereof, a laser annealing treatment is performed to form the crystalline silicon film. Then, this crystalline silicon film is subjected to a patterning process using a photolithography method, to obtain the semiconductor layers 5003 to 5006.

Further, after the formation of the semiconductor layers 5003 to 5006, a minute amount of impurity element (boron or phosphorus) may be doped to control a threshold value of the TFT.

Besides, in the case where the crystalline semiconductor film is manufactured by the laser crystallization method, a pulse-oscillation type or continuous-wave type excimer laser, YAG laser, or $YVO_4$ laser may be used. In the case where those kinds of laser are used, it is appropriate to use a method in which laser light radiated from a laser oscillator is condensed by an optical system into a linear beam, and is irradiated to the semiconductor film. Although the conditions of the crystallization should be properly selected by an operator, in the case where the excimer laser is used, a pulse oscillation frequency is set as 30 Hz, and a laser energy density is set as 100 to 400 mJ/cm$^2$ (typically 200 to 300 mJ/cm$^2$). In the case where the YAG laser is used, it is appropriate that the second harmonic is used to with a pulse oscillation frequency of 1 to 10 kHz and a laser energy density of 300 to 600 mj/cm$^2$ (typically, 350 to 500 mJ/cm$^2$). Then, laser light condensed into a linear shape with a width of 100 to 1000 μm, for example, 400 μm is irradiated to the whole surface of the substrate, and an overlapping ratio (overlap ratio) of the linear laser light at this time may be set as 50 to 90%.

A gate insulating film 5007 is then formed for covering the semiconductor layers 5003 to 5006. The gate insulating film 5007 is formed of an insulating film containing silicon by a plasma CVD method or a sputtering method into a film thickness of from 40 to 150 nm. In this embodiment, the gate insulating film 5007 is formed of a silicon nitride oxide film into a thickness of 110 nm by a plasma CVD method (composition ratio Si=32%, O=59%, N=7%, and H=2%). Of course, the gate insulating film 5007 is not limited to the silicon nitride oxide film, and an other insulating film containing silicon may be used as a single layer or a lamination structure.

Besides, when the silicon oxide film is used, it can be possible to be formed by a plasma CVD method in which TEOS (tetraethyl orthosilicate) and $O_2$, are mixed and discharged at a high frequency (13.56 MHz) power density of 0.5 to 0.8 W/cm$^2$ with a reaction pressure of 40 Pa and a substrate temperature of 300 to 400° C. Good characteristics as the gate insulating film can be obtained in the manufactured silicon oxide film thus by subsequent thermal annealing at 400 to 500° C.

Then, on the gate insulating film 5007, a first conductive film 5008 with a thickness of 20 to 100 nm and a second conductive film 5009 with a thickness of 100 to 400 nm are formed and laminated. In this embodiment, the first conductive film 5007 of TaN film with a film thickness of 30 nm and the second conductive film 5008 of a W film with a film thickness of 370 nm are formed into lamination. The TaN film is formed by sputtering with a Ta target under a nitrogen containing atmosphere. Besides, the W film is formed by the sputtering method with a W target. The W film may be formed by a thermal CVD method using tungsten hexafluoride ($WF_6$). Whichever method is used, it is necessary to make the material have low resistance for use as the gate electrode, and it is preferred that the resistivity of the W film is set to less than or equal to 20 μΩcm. By making the crystal grains large, it is possible to make the W film have lower resistivity. However, in the case where many impurity elements such as oxygen are contained within the W film, crystallization is inhibited and the resistance becomes higher. Therefore, in this embodiment, by forming the W film by a sputtering method using a target with a purity of 99.9999%, and in addition, by taking sufficient consideration to prevent impurities within the gas phase from mixing therein during the film formation, a resistivity of from 9 to 20 μΩcm can be realized.

Note that, in this embodiment, the first conductive film 5008 is made of TaN, and the second conductive film 5009 is made of W, but the material is not particularly limited thereto, and either film may be formed of an element selected from the group consisting of Ta, W, Ti, Mo, Al, Cu, Cr, and Nd, or an alloy material or a compound material containing the above element as its main constituent. Besides, a semiconductor film, typified by a polycrystalline silicon film doped with an impurity element such as phosphorus, may be used. Further, an AgPdCu alloy may be used. Besides, any combination may be employed such as a combination in which the first conductive film is formed of tantalum (Ta) and the second conductive film is formed of W, a combination in which the first conductive film is formed of titanium nitride (TiN) and the second conductive film is formed of W, a combination in which the first conductive film is formed of tantalum nitride (TaN) and the second conductive film is formed of Al, or a combination in which the first conductive film is formed of tantalum nitride (TaN) and the second conductive film is formed of Cu.

Next, as shown in FIG. 16B, mask 5010 made of resist are formed using a photolithography method, and a first etching process is performed in order to form electrodes and wirings. This first etching process is performed with the first and second etching conditions. In this embodiment, as the first etching conditions, an ICP (inductively coupled plasma) etching method is used, a gas mixture of $CF_4$, $Cl_2$and $O_2$ is used as an etching gas, the gas flow rate is set to 25/25/10 sccm, and plasma is generated by applying a 500 W RF (13.56 MHz) power to a coil shape electrode under 1 Pa. A dry etching device with ICP (Model E645-□ICP) produced by Matsushita Electric Industrial Co. Ltd. is used here. A 150 W RF (13.56 MHz) power is also applied to the substrate side (test piece stage) to effectively apply a negative self-bias voltage. The W film is etched with the first etching conditions, and the end portion of the second conductive layer is formed into a tapered shape. In the first etching conditions, the etching rate for W is 200.39 nm/min., the etching rate for TaN is 80.32 nm/min, and the selectivity of W to TaN is about 2.5. Further, the taper angle of W is about 26° with the first etching conditions.

Thereafter, as shown in FIG. 16B, the first etching conditions are changed into the second etching conditions without removing the mask 5010 made of resist, a mixed gas of $CF_4$ and $Cl_2$ is used as an etching gas, the gas flow rate is set to 30/30 sccm, and plasma is generated by applying a 500 W RF (13.56 MHz) power to a coil shape electrode under 1 Pa to thereby perform etching for about 30 seconds. A 20W RF (13.56 MHz) power is also applied to the substrate side (test piece stage) to effectively a negative self-bias voltage. The W film and the TaN film are both etched on the same order with the second etching conditions in which $CF_4$ and $Cl_2$are mixed. In the second etching conditions, the etching rate for W is 58.97 nm/min, and the etching rate for TaN is 66.43 nm/min. Note that, the etching time may be increased by approximately 10 to 20% in order to perform etching without any residue on the gate insulating film.

In the first etching process, the end portions of the first and second conductive layers are formed to have a tapered shape due to the effect of the bias voltage applied to the substrate side by adopting masks of resist with a suitable shape. The angle of the tapered portions may be set to 15° to 45°. Thus, first shape conductive layers 5011 to 5015 (first conductive layers 5011*a* to 5015*a* and second conductive layers 5011*b* to 5015*b*) constituted of the first conductive layers and the second conductive layers are formed by the first etching process. Reference numeral 5007 denotes a gate insulating film, and regions of the gate insulating film which are not covered by the first shape conductive layers 5011 to 5015 are made thinner by approximately 20 to 50 nm by etching.

Then, a first doping process is performed to add an impurity element for imparting an n-type conductivity to the semiconductor layer without removing the mask made of resist (FIG. 5B). Doping may be carried out by an ion doping method or an ion implantation method. The condition of the ion doping method is that a dosage is $1\times10^{13}$ to $5\times10^{15}$ atoms/$cm^2$, and an acceleration voltage is 60 to 100 keV. In this embodiment, the dosage is $1.5\times10^{15}$ atoms/$cm^2$ and the acceleration voltage is 80 keV. As the impurity element for imparting the n-type conductivity, an element which belongs to group 15 of the periodic table, typically phosphorus (P) or arsenic (As) is used, and phosphorus is used here. In this case, the conductive layers 5011 to 5015 become masks to the impurity element for imparting the n-type conductivity, and high concentration impurity regions 5016 to 5019 are formed in a self-aligning manner. The impurity element for imparting the n-type conductivity is added to the high concentration impurity regions 5016 to 5019 in the concentration range of $1\times10^{20}$ to $1\times10^{21}$ atoms/$cm^3$.

Thereafter, as shown in FIG. 16C, the second etching process is performed without removing the masks made of resist. Here, a mixed gas of $CF_4$, $Cl_2$ and $O_2$is used as an etching gas, the gas flow rate is set to 20/20/20 sccm, and plasma is generated by applying a 500 W RF (13.56 MHz) power to a coil shape electrode under 1 Pa to thereby perform etching. A 20 W RF (13.56 MHz) power is also applied to the substrate side (test piece stage) to effectively apply a negative self-bias voltage. In the second etching process, the etching rate for W is 124.62 nm/min, the etching rate for TaN is 20.67 nm/min, and the selectivity of W to TaN is 6.05. Accordingly, the W film is selectively etched. The taper angle of W is 70° in the second etching. Second conductive layers 5020*b* to 5024*b* are formed by the second etching process. On the other hand, the first conductive layers 5011*a* to 5015*a* are hardly etched, and first conductive layers 5020*a* to 5024*a* are formed.

Next, a second doping process is performed. Second conductive layers 5020*b*to 5024*b* are used as masks to an impurity element, and doping is performed such that the impurity element is added to the semiconductor layer below the tapered portions of the first conductive layers. In this embodiment, phosphorus (P) is used as the impurity element, and plasma doping is performed with the dosage of $1.5\times10^{14}$ atoms/$cm^2$, the current density 0.5 μA and the acceleration voltage of 90 keV. Thus, low concentration impurity regions 5025 to 5028, which overlap with the first conductive layers, are formed in a self-aligning manner. The concentration of phosphorus (P) in the low concentration impurity regions 5025 to 5028 is $1\times10^{17}$ to $5\times10^{18}$ atoms/$cm^3$, and has a gentle concentration gradient in accordance with the film thickness of the tapered portions of the first conductive layers. Note that, in the semiconductor layer that overlaps with the tapered portions of the first conductive layers, the concentration of the impurity element slightly falls from the end portions of the tapered portions of the first conductive layers toward the inner portions. The concentration, however, keeps almost the same level. Further, the impurity element is added to the high concentration impurity regions 5016 to 5019. (FIG. 17A)

Figures 17A, 17B, 17C:
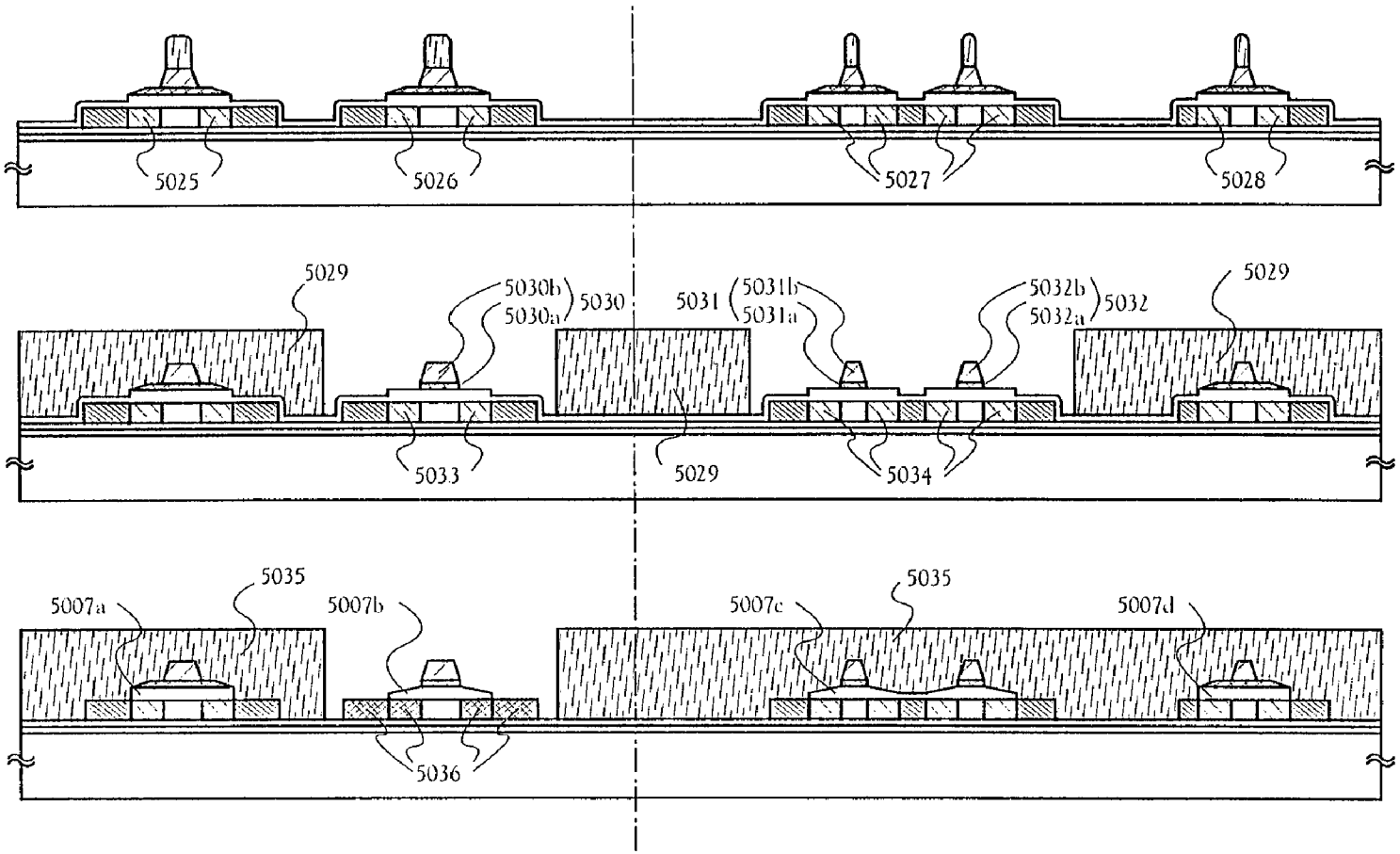
FIGS. 17A to 17C are diagrams showing examples of the manufacturing process of the liquid crystal display device of Embodiment 2.

Subsequently, as shown in FIG. 17B, after the masks made of resist are removed, a third etching process is conducted using a photolithography method. In this third etching process, the tapered portions of the first conductive layers are partially etched to make the first conductive layers have shapes overlapping the second conductive layers. However, masks made of resist 5029 are formed in the regions to which the third etching process is not conducted.

Etching conditions in the third etching process are such that $Cl_2$ and $SF_6$ are used as etching gases, a gas flow rate is set to 10/50 sccm, and the ICP etching method is used as in the first and second etching processes. Note that, in the third etching process, the etching rate to TaN is 111.2 nm/min and the etching rate to the gate insulating film is 12.8 nm/min.

In this embodiment, etching is performed such that an RF (13.56 MHz) power of 500 W is applied to a coil shape electrode with a pressure of 1.3 Pa to generate plasma. An RF (13.56 MHz) power of 10 W is applied to the substrate side (sample stage), thereby applying substantially a negative self-bias voltage. Thus, first conductive layers 5030*a* to 5032*a* are formed.

Through the third etching process, impurity regions (LDD regions) 5033 and 5034 are formed, which do not overlap the first conductive layers 5030*a* to 5032*a*. Note that the impurity regions (GOLD regions) 5025 and 5028 remain overlapping the first conductive layers 5020*a* and 5024*a*, respectively.

As described above, in this embodiment, the impurity regions (LDD regions) 5033 and 5034 not overlapping the first conductive layers and the impurity regions (GOLD regions) 5025 and 5028 overlapping the first conductive layers can be simultaneously formed. Thus, the impurity regions can be separately formed in accordance with the TFT characteristics.

Subsequently, after the masks made of resist are removed, the gate insulating film 5007 is subjected to an etching process. This etching process is conducted using $CHF_3$ as an etching gas by a reactive ion etching method (RIE method). In this embodiment, the third etching process is conducted with a chamber pressure of 6.7 Pa, RF power of 800 W and a $CHF_3$ gas flow rate of 35 sccm. Thus, parts of the high concentration impurity regions 5016 to 5019 are exposed, and gate insulating films 5007*a* to 5007*d* are formed.

Next, masks 5035 made of resist are newly formed, and a third doping process is conducted. By this third doping process, impurity regions 5036 added with the impurity element imparting the second conductivity type (p-type) opposite to the first conductivity type (n-type) are formed in the semiconductor layer that becomes an active layer of a p-channel TFT (FIG. 17C). The first conductive layer 5030*a* is used as a mask to the impurity element, and the impurity element imparting p-type conductivity is added to thereby form the impurity regions in a self-aligning manner.

In this embodiment, the impurity regions 5036 are formed by an ion doping method using diborane ($B_2H_6$). Note that the semiconductor layers forming n-channel TFTs are covered by the masks 5035 made of resist in this third doping process. By the first doping process and the second doping process, the impurity regions 5036 are added with phosphorous at different concentrations. However, in any of the regions, the doping process is performed such that the concentration of the impurity element imparting p-type conductivity is $2\times10^{20}$ to $2\times10^{21}$ atoms/cm$^3$. Thus, no problem occurs since the impurity regions function as the source regions and drain regions of the p-channel TFT.

Through the above-described processes, the impurity regions are formed in the respective semiconductor layers. Note that, in this embodiment, a method is shown, in which doping of the impurity element (B) is performed after etching the gate insulating film, but doping of the impurity element may be conducted without etching the gate insulating film.

Figures 18A, 18B, 18C:
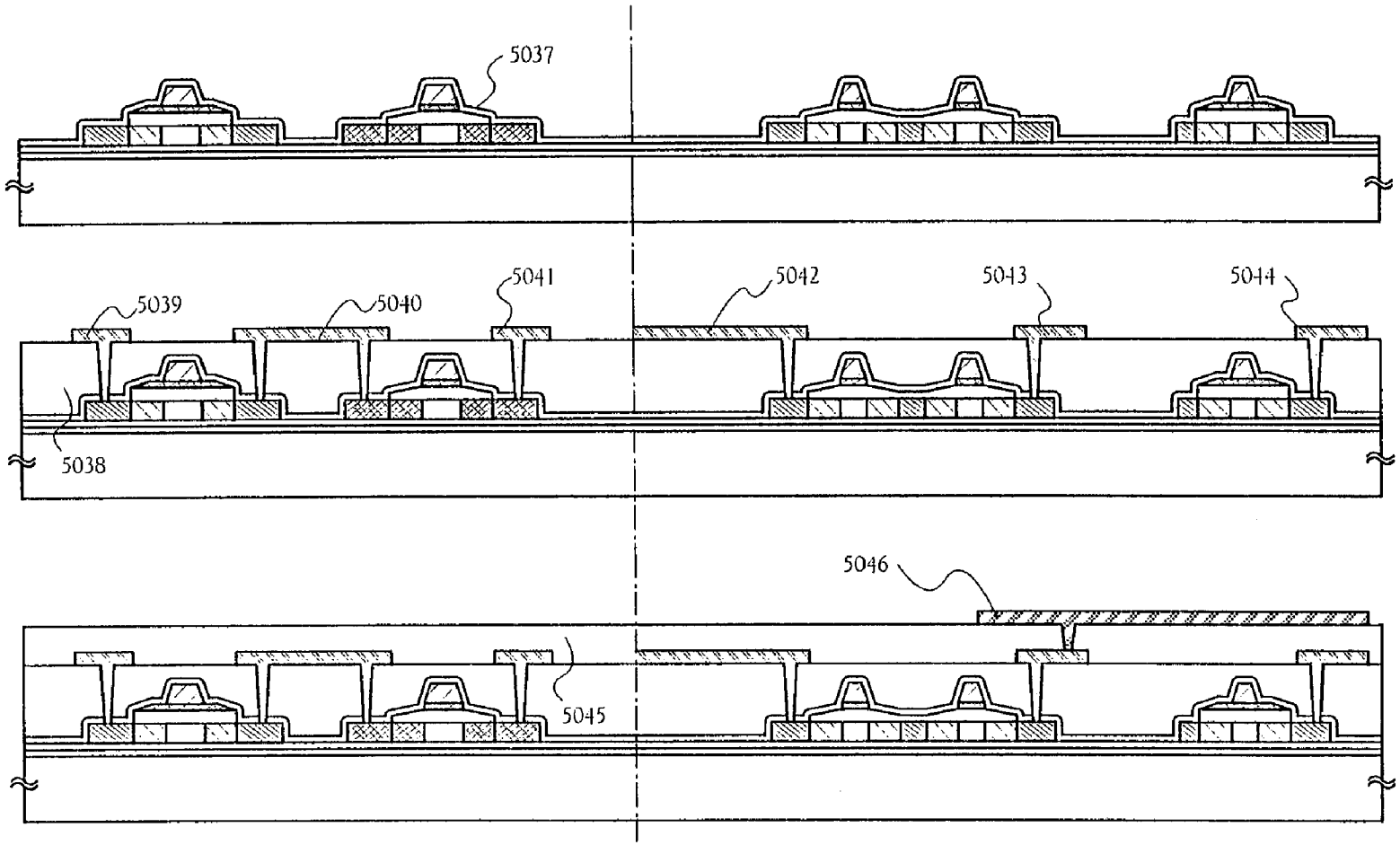
FIGS. 18A to 18C are diagrams showing examples of the manufacturing process of the Liquid crystal display device of Embodiment 2.

Subsequently, the masks 5035 made of resist are removed, and a first interlayer insulating film 5037 is formed as shown in FIG. 18A. As the first interlayer insulating film 5037, an insulating film containing silicon is formed with a thickness of 100 to 200 nm, by using a plasma CVD method or a sputtering method. In this embodiment, a silicon oxide nitride film is formed with a thickness of 150 nm by the plasma CVD method. Of course, the first interlayer insulating film 5037 is not limited to the silicon oxide nitride film, and other insulating films containing silicon may also be used in a single layer or a lamination structure.

Then, a process of activating the impurity elements added into the respective semiconductor layers is conducted. This activation process is performed by a thermal annealing method using an annealing furnace. The thermal annealing method may be conducted with an oxygen concentration of 1 ppm or less, preferably 0.1 ppm or less in a nitrogen atmosphere at 400 to 700° C., typically, 500 to 550° C. In this embodiment, the activation process is performed by a heating process at 550° C. for 4 hours. Note that, in addition to the thermal annealing method, a laser annealing method or a rapid thermal annealing method (RTA method) may be applied.

Note that, in this embodiment, with the activation process, Ni used as a catalyst in the crystallization is gettered to the impurity region containing P at high concentration to reduce the nickel concentration in the semiconductor layer that mainly becomes a channel forming region. The TFT having the channel forming region thus manufactured has the lowered off current value and the good crystallinity. Thus, a high electric field effect mobility can be obtained, thereby being capable of achieving the satisfactory characteristics.

Further, before the formation of the first interlayer insulating film 5037, the activation process may be conducted. However, in the case where the used wiring material is weak to heat, it is preferable that the activation process is performed after the interlayer insulating film 5037 (the insulating film containing silicon as its main constituent, for example, silicon nitride film) is formed to protect the wirings or the like as in this embodiment.

Besides, the doping process maybe conducted after the activation process, and then, the first interlayer insulating film 5037 may be formed.

Furthermore, a heating process at 300 to 550° C. for 1 to 12 hours is conducted in an atmosphere containing hydrogen of 3 to 100%, thereby conducting a step of hydrogenating the semiconductor layers. In this embodiment, a heating process is conducted at 410° C. for 1 hour in a nitrogen atmosphere containing hydrogen of approximately 3%. This is a step of terminating dangling bonds in the semiconductor layer by hydrogen contained in the interlayer insulating film 5037. As another means for hydrogenation, plasma hydrogenation (using hydrogen excited by plasma) may be carried out.

Moreover, in the case where a laser annealing method is used for the activation process, it is desirable that laser light emitted from an excimer laser, a YAG laser or the like is irradiated after the hydrogenation.

Next, as shown in FIG. 18B, a second interlayer insulating film 5038 made from an organic insulating material is formed on the first interlayer insulating film 5037. In this embodiment, an acrylic resin film is formed with a thickness of 1.6 μm. Thereafter, patterning is performed for forming contact holes that reach the respective impurity regions 5016, 5018, 5019, and 5036.

A film formed from an insulating material containing silicon or organic resin is used as the second interlayer insulating film 5038. Silicon oxide, silicon nitride, and silicon oxide nitride may be used for the insulating material containing silicon, and polyimide, polyamide, acryl, BCB (benzocyclobutene) and the like may be used for the organic resin.

In this embodiment, a silicon oxide nitride film is formed by a plasma CVD method. Note that the thickness of the silicon oxide nitride film is preferably 1 to 5 μm (more preferably 2 to 4 μm). The silicon oxide nitride film is effective in suppressing deterioration of the EL element since the amount of moisture contained in the film itself is small.

Further, dry etching or wet etching may be used for the formation of the contact holes. However, taking the problem of electrostatic destruction in etching into consideration, the wet etching method is desirably used.

Furthermore, in the formation of the contact holes here, the first interlayer insulating film 5037 and the second interlayer insulating film 5038 are etched at the same time. Thus, in consideration for the shape of the contact hole, it is preferable that the material with an etching rate faster than that of the material for forming the first interlayer insulating film 5037 is used as the material for forming the second interlayer insulating film 5038.

Then, wirings 5039 to 5044, which are electrically connected with the impurity regions 5016, 5018, 5019, and 5036, respectively, are formed. Here, the wirings are formed by patterning a lamination film of a Ti film of 50 nm thickness and an alloy film (alloy film of Al and Ti) of 500 nm thickness, but other conductive films may also be used.

As described above, the driver circuit 5101 having the n-channel TFT 5102 and the p-channel TFT 5103, and the pixel portion 5100 having the pixel TFT 5104 and the storage capacitor 5105 can be formed over the same substrate. In this specification, such a substrate is referred to as an active matrix substrate.

Further, as for the storage capacitor, before the formation of the gate conductive films, doping of impurity elements may be performed on necessary portions to form capacitors. One photo resist mask is increased with this method, but the storage capacitor can be formed without applying bias.

Subsequently, a third interlayer insulating film 5045 is formed. This process is performed so as to level the surface on which a TFT is formed for the subsequent formation of a pixel electrode. Thus, it is desirable that the third interlayer insulating film 5045 is formed of an insulating film made of a resin film such as acryl, which has an excellent leveling property. Then, an MgAg film is formed thereon, and a pixel electrode (reflecting electrode) 5046 is formed by patterning the film (FIG. 18C).

Figure 19:
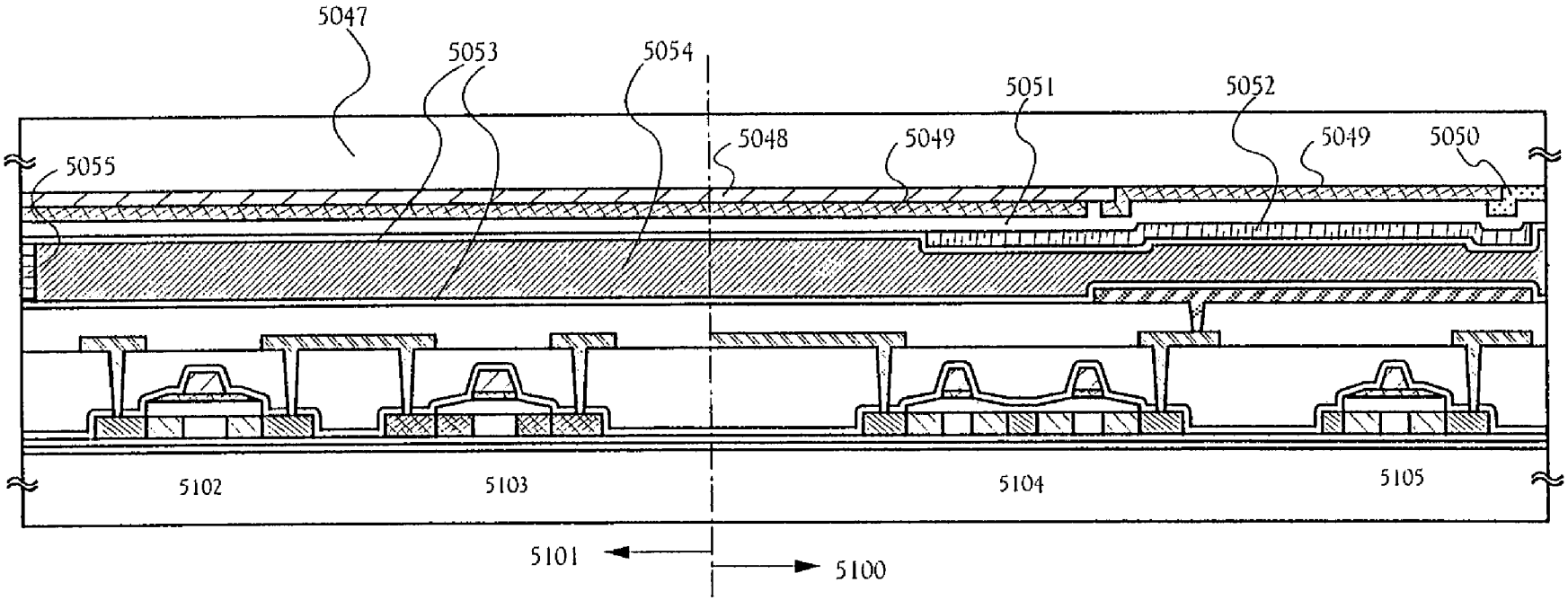
FIG. 19 is a diagram showing examples of the manufacturing process of the liquid crystal display device of Embodiment 2.

On the other hand, an opposing substrate 5047 is prepared. As shown in FIG. 19, the opposing substrate 5047 is provided with color filter layers 5048 to 5050, and an overcoat layer 5051. The color filter layers are structured such that the color filter layers 5048 and 5049 of different colors are formed in an overlapping manner above the TFTs, and serve also as a light shielding film. Note that the color filter layers of respective colors are formed from resin mixed with pigment with a thickness of 1 to 3 μm. A photosensitive material is used for the color filter layers, and a predetermined pattern can be formed using a mask. Simultaneously, a spacer (not shown) is formed by using the color filter layers. The spacer may be formed by forming the color filters in an overlapping manner. The height of the spacer can be set to 2 to 7 μm, preferably 4 to 6 μm by taking the thickness of the overcoat layer 5051 of 1 to 4 μm into consideration. The height enables the formation of a gap in bonding the active matrix substrate and the opposing substrate. The overcoat layer 5051 is formed from an optically hardened or thermally hardened type organic resin material, and polyimide, acrylic resin or the like may be used.

After the formation of the overcoat layer 5051, an opposing electrode 5052 made of a transparent conductive film is formed by patterning. Thereafter, an orientation film 5053 is formed on both the active matrix substrate and the opposing substrate, and a rubbing process is performed.

Thereafter, the active matrix substrate and the opposing substrate are bonded by a sealant 5055. The sealant 5055 is mixed with a filler, and the two substrates are bonded with a uniform interval by the filler and the spacer. Subsequently, a liquid crystal material 5054 is injected between both the substrates to completely encapsulate the liquid crystal material 5054 by an encapsulant (not shown). A known liquid crystal material may be used as the liquid crystal material 5054. As described above, the active matrix liquid crystal display device as shown in FIG. 19 is completed.

Note that the TFT in the active matrix liquid crystal display device manufactured by the above-described processes takes a top gate structure. However, this embodiment can also be applied with ease with respect to a bottom gate structure TFT and TFTs having other structures.

Further, a glass substrate is used in this embodiment, but there is no limitation on the substrate. This embodiment can be implemented in the case where a plastic substrate, a stainless substrate, a single crystal wafer, or the like other than the glass substrate is used.

Embodiment 3

In the liquid crystal display device of the present invention, which is shown in the embodiment mode, the capacitor type D/A converter (C-DAC) is adopted for the D/A converter arranged in the pixel portion. However, the present invention can be easily implemented even with the employment of another type D/A converter. In this embodiment, an example is described, in which a pixel portion is structured by using a D/A converter different from that in the embodiment mode.

Figure 10A:
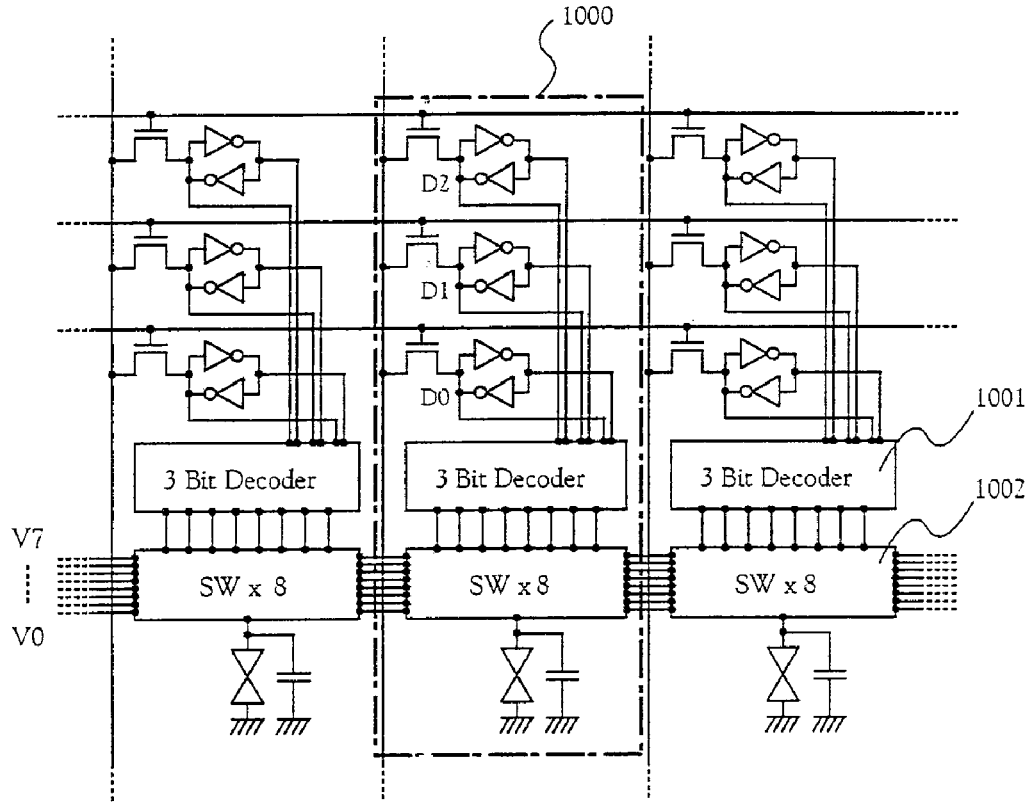
FIGS. 10A to 10C are circuit diagrams of a pixel having a D/A converter constituted of a plurality of gradation power source lines and decoders of Embodiment 3.
Figure 10B:
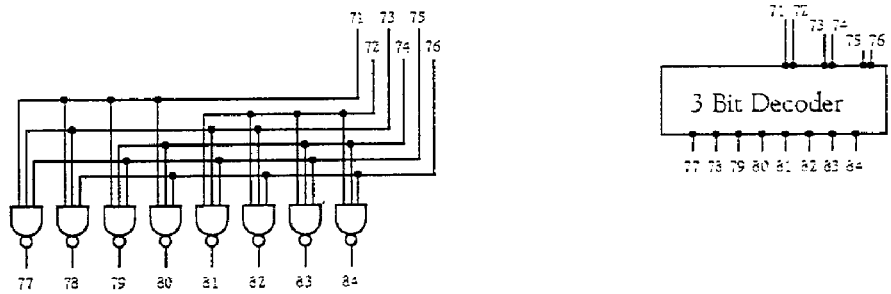
Figure 10C:
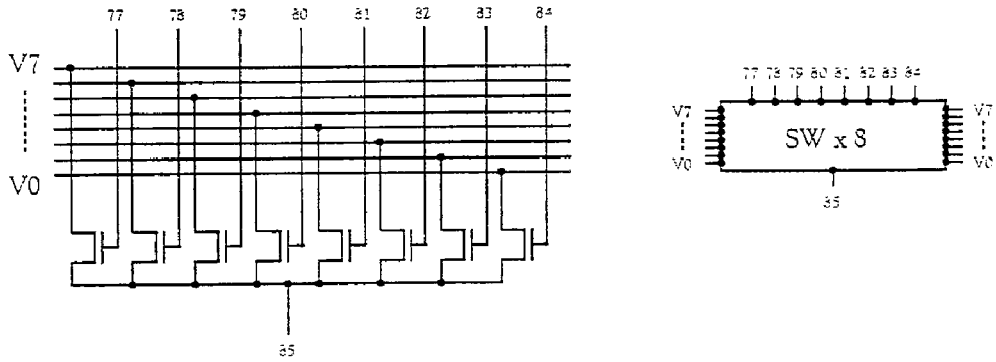

One example is shown in FIG. 10A. A circuit diagram of pixels shown in FIG. 10A corresponds to a 3-bit digital image signal, similarly to the circuit diagram in the embodiment mode. A portion surrounded by a dotted line frame 1000 corresponds to one pixel. 8 gradation power source lines are arranged in the pixel portion, and are provided with electric potentials in 8 levels; V0, V1, . . . , V7, respectively. The 3-bit digital image signal stored in the memory circuits is input to a decoder 1001. The decoder 1001 is constituted of 8 ($2^3$) of 3-input NAND circuits as shown in FIG. 10B. Reference numerals attached to input/output pins of the block diagram correspond to reference numerals attached to inputs/outputs of the circuit diagram. When the 3-bit digital image signal is input to the decoder, an output is obtained from any of 77 to 84. This output pulse is input to a switch 1002, and as shown in FIG. 10C, any one of the 8 gradation power source lines is selected to apply the electric potential of the selected gradation power source line to the liquid crystal element. Note that inversion of positive and negative with respect to the electric potential may be conducted for a constant period (for example, one frame period) in order to perform inversion drive. In the case where gradation expression is conducted using the D/A converter with the above structure, $2^n$ gradation power source lines are required with respect to n-bit gradation.

Figure 11A:
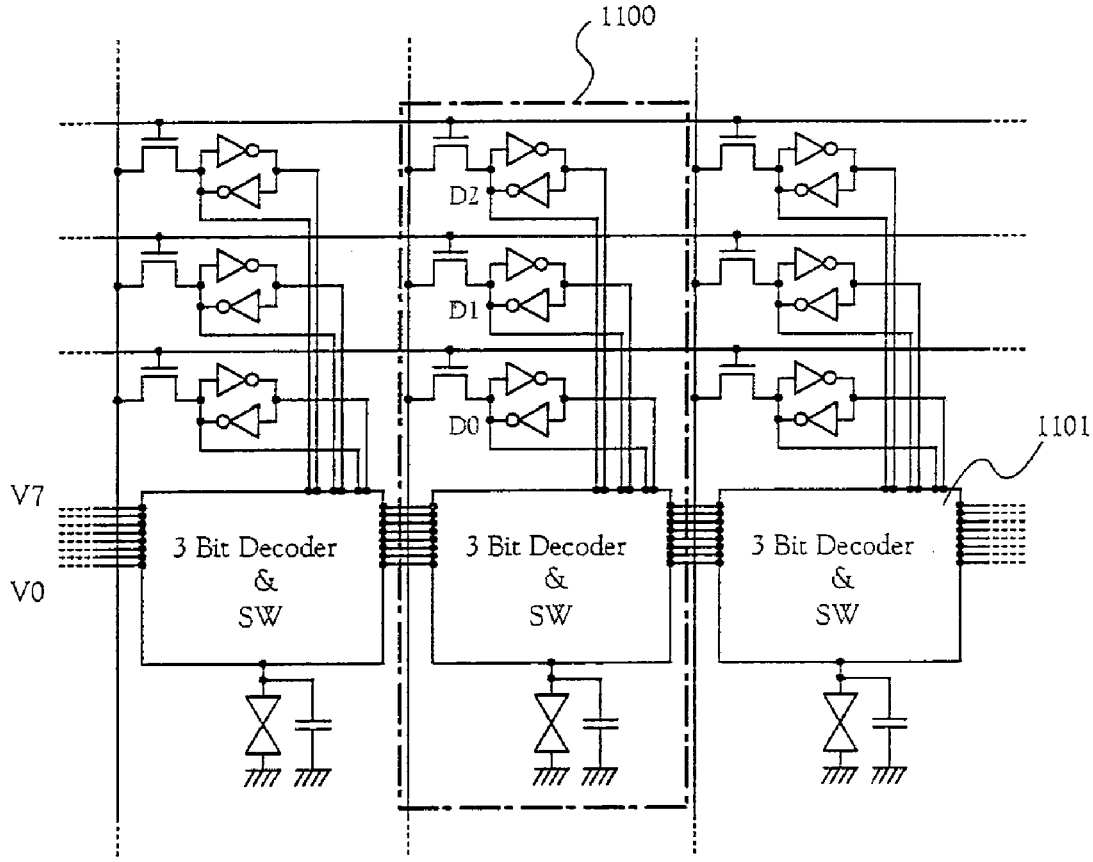
FIGS. 11A and 11B are circuit diagrams of a pixel having a D/A converter constituted of a plurality of gradation power source lines and decoders of Embodiment 3.
Figure 11B:
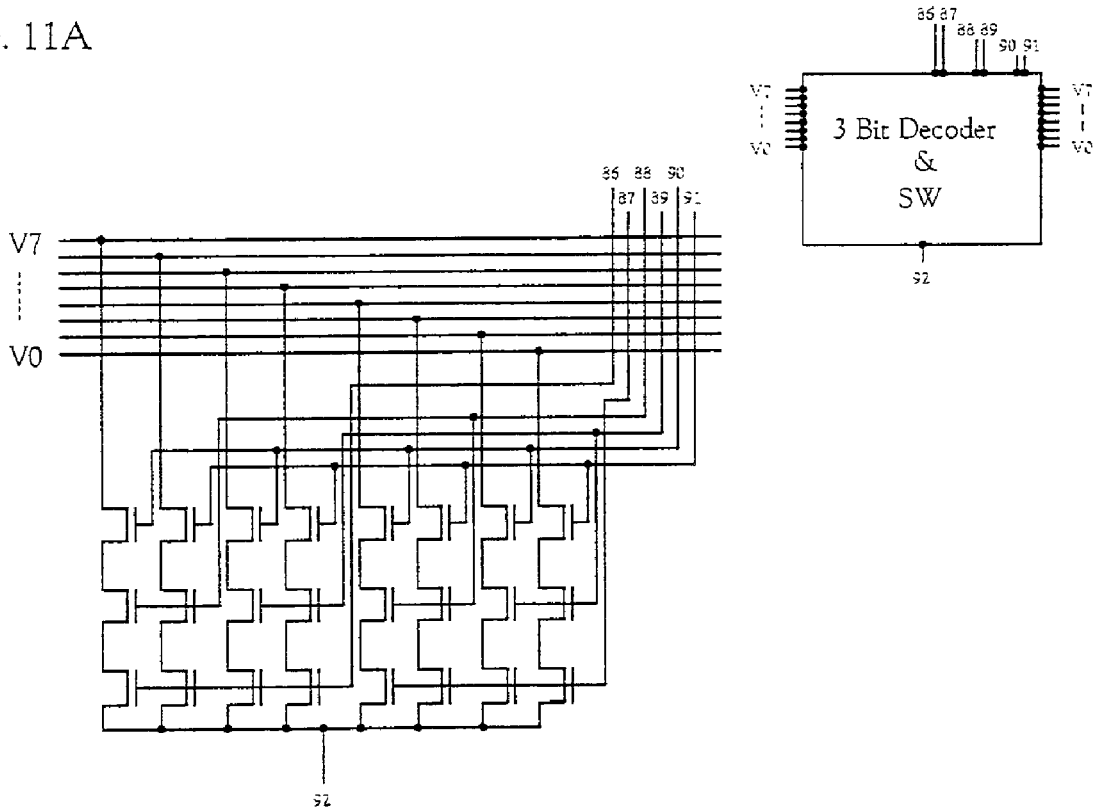

Similarly, another example of pixels each having a D/A converter using a decoder is shown in FIG. 11A. Contrary to the D/A converter constituted by using the 3-input NAND circuits, in the pixel shown in FIG. 11A, the D/A converter and a switch circuit are integrally formed as shown in FIG. 11B. Thus, a decrease in the number of elements is attained. The liquid crystal element is applied with the electric potential from each gradation power source line through 3 TFTs in series.

In the D/A converter of the pixel shown in FIG. 10 or FIG. 11, a single TFT is used as the switch of a potential output portion for the explanation. However, stabilization of the operation may be attained by using an analog switch, a transmission gate, or the like.

Embodiment 4

A liquid crystal display device of the present invention enables the lower power consumption by mounting decoders on a source signal line driver circuit and a gate signal line driver circuit. One example thereof is shown below.

Figure 13A:
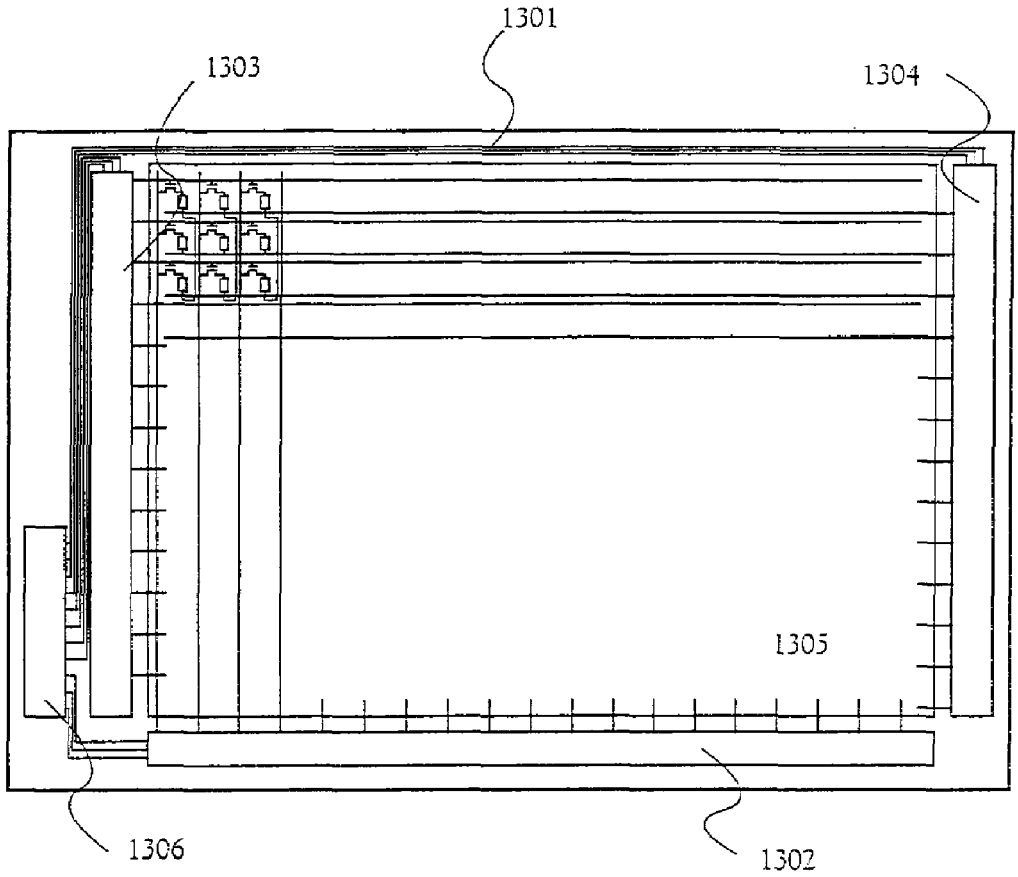
FIGS. 13A and 13B are diagrams showing an example in which an X-address decoder and a Y-address decoder are added to the liquid crystal display device of Embodiment 4.
Figure 13B:
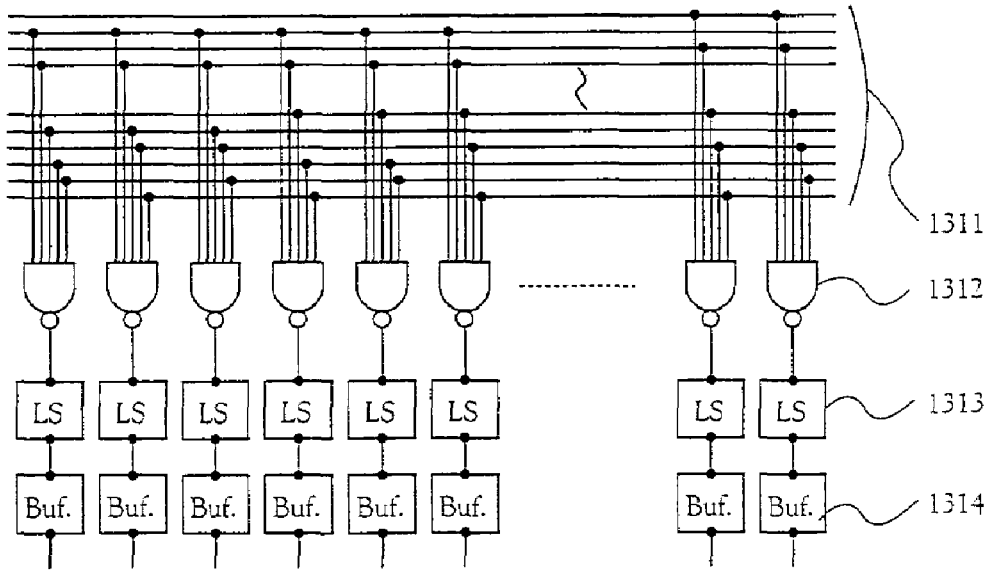

FIG. 13A is an overall schematic diagram in which the decoders are mounted on a source signal line and a gate signal line in the liquid crystal display device of the present invention. A pixel portion 1305 is arranged in the center of a substrate 1301. On the upper side of the pixel portion is arranged the source signal line driver circuit and X-address decoder 1302 for controlling source signal lines. On the right and left sides of the pixel portion are arranged the gate signal line driver circuit and Y-address decoder 1303 for controlling gate signal lines and a DAC controller 1304. A circuit diagram of the decoder portion is shown in FIG. 13B. The decoder portion has an address signal line 1311, a NAND circuit 1312, a level shifter 1313, a buffer 1314, and the like. In case of an n-bit address signal, an n-input NAND circuit is used. Such decoders are used on the source signal line side and on the gate signal line side, whereby an arbitrary selection of coordinates is possible in a display region of the pixel portion 1305. That is, in the case where a renewal is conducted on only a part of a screen, only the part is selected by the decoders, and write to the memory circuits of the pixel may be conducted. With respect to the portion where a renewal of the image signal is not performed, a display of a static image is continuously performed in accordance with the image signal stored in the memory circuits.

Note that the decoder as shown in FIG. 13B may be used on both the source signal line side and the gate signal line side, but this is simply one example of the circuit structure. There is no limitation on the form of a decoder.

Embodiment 5

Figure 20:
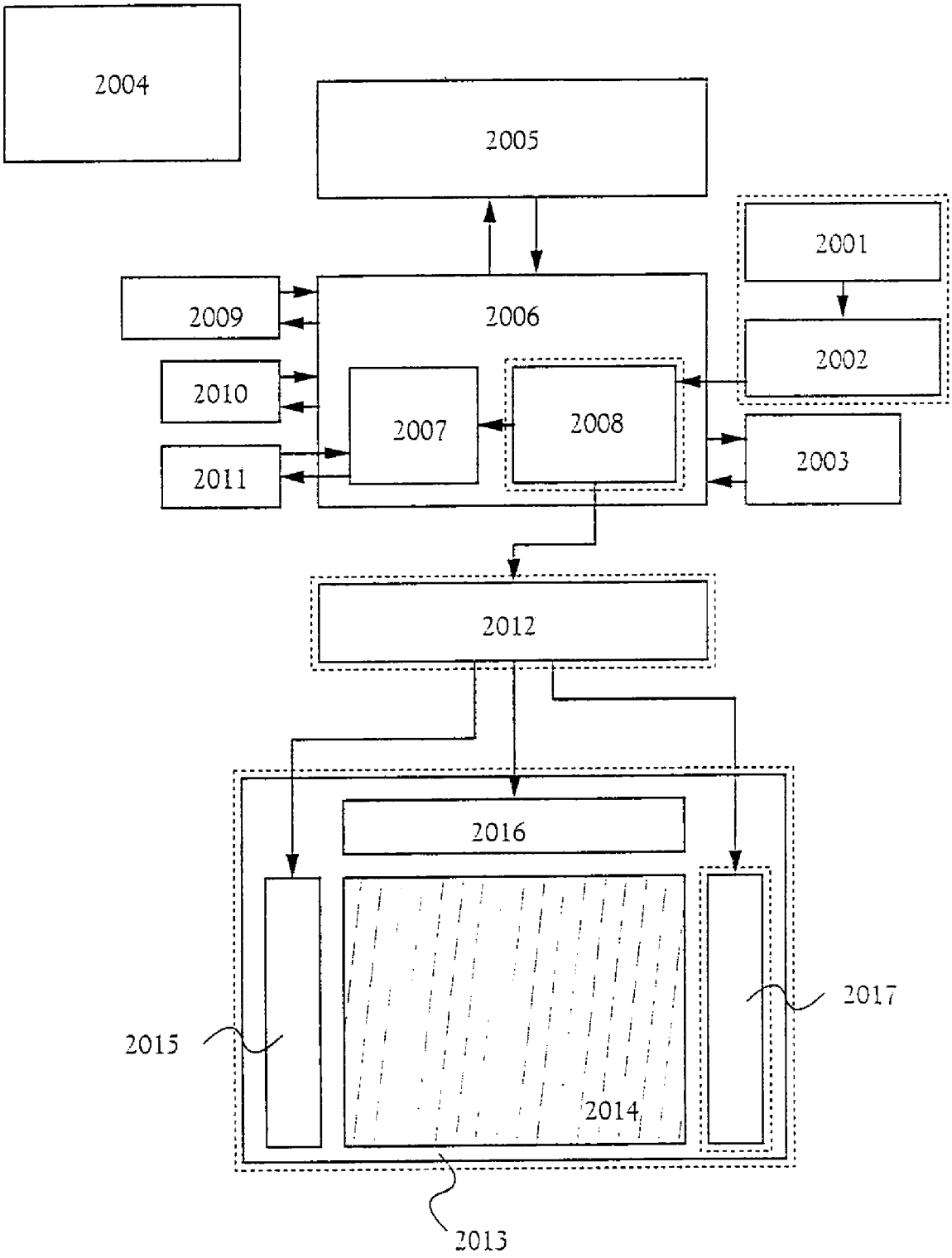
FIG. 20 is a block diagram showing a structure of a portable information terminal of Embodiment 5.

FIG. 20 shows an example in which the liquid crystal display device of the present invention is applied to a portable information terminal. Note, reference numeral 2001 indicates a pen input tablet; 2002, a detection circuit; 2003, a memory card; 2004, a power source; 2005, an external interface port; 2006, a CPU; 2007, an image signal processing circuit; 2008, a tablet interface; 2009, a flash memory; 2010, a DRAM/; 2011, a VRAM; 2012, a LCD controller; 2013, a liquid crystal display device; 2014, a pixel portion; 2015, a gate signal line driver circuit; 2016, a source signal line driver circuit; and 2017, a DAC controller. In this embodiment, in case of a static image display, the functions of an image signal processing circuit 2007 of a CPU 2006, a VRAM 2011, and the like are stopped, thereby being capable of attaining the low power consumption. In FIG. 20, the operation during the static image display is conducted only in the circuits surrounded by dotted line frames. Further, an LCD controller 2012 may be mounted to a liquid crystal display device 2013 by COG, or may be integrally formed with the liquid crystal display device on the substrate.

Figure 21:
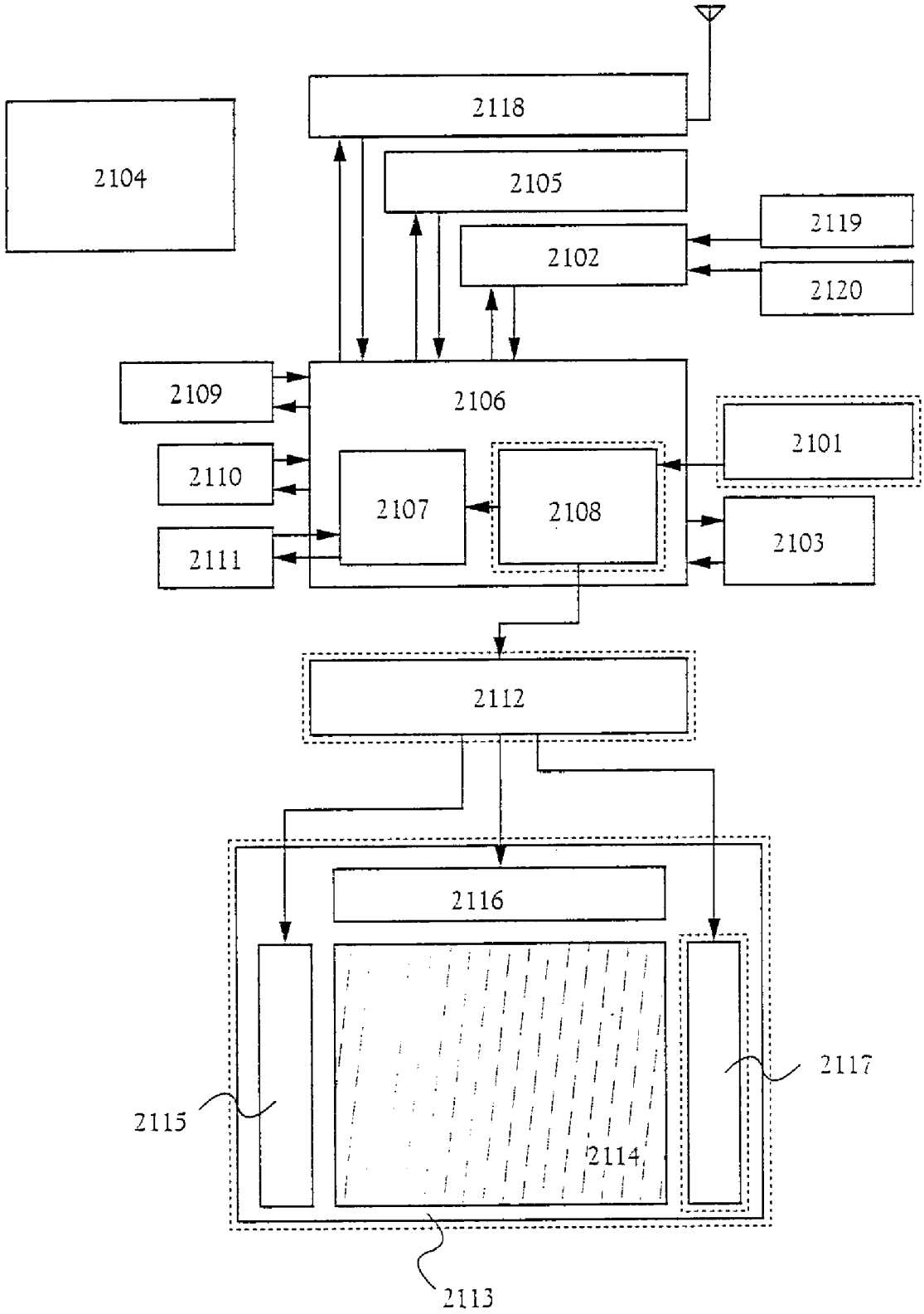
FIG. 21 is a block diagram showing a structure of a portable telephone of Embodiment 5.

Further, FIG. 21 shows an example in which the liquid crystal display device of the present invention is applied to a portable telephone. Similarly to the above-described portable information terminal, the operation of some circuits can be stopped during the static image display. Thus, the low power consumption can be attained. In addition, reference numeral 2101 indicates a keyboard; 2102, a voice processing circuit; 2103, a memory card; 2104, a power source; 2105, an external interface port; 2106, a CPU; 2107, an image signal processing circuit; 2108, a keyboard interface; 2109, a flash memory; 2101, a DRAM; 2111, a VRAM; 2117, a LCD controller; 2113, a liquid crystal display device; 2114, a pixel portion; 2115, a gate signal line driver circuit; 2116, a source signal line driver circuit; 2117, a DAC controller; 2118, a sending and receiving circuit; 2119, a microphone; and 2120, a speaker.

Embodiment 6

The liquid crystal display device of the present invention has various usages. In this embodiment, the application example of electronic devices incorporating the liquid crystal display device of the present intention is explained.

The following can be given as examples of such electronic devices: a portable information terminal (such as an electronic book, a mobile computer, a mobile telephone); a video camera; a digital camera; a personal computer; a television and a projector device and like that. Examples of these electronic devices are shown in FIGS. 22A to 23C.

Figure 22A:
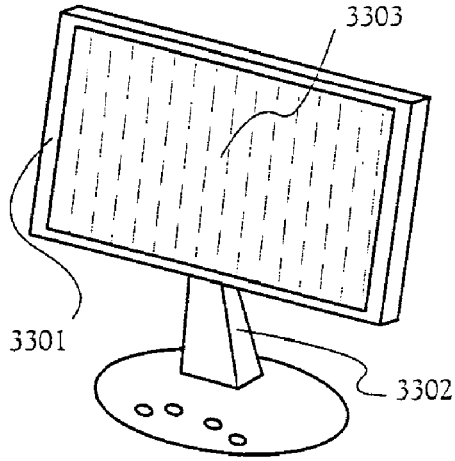
FIGS. 22A to 22D are diagrams showing examples of electronic equipment to which the liquid crystal display device of the present invention is applied in Embodiment 6.

FIG. 22A is a liquid crystal display (LCD) apparatus, containing a casing 3301, a support stand 3302, and a display portion 3303. The liquid crystal display device of the present invention can be used in the display portion 3303.

Figure 22B:
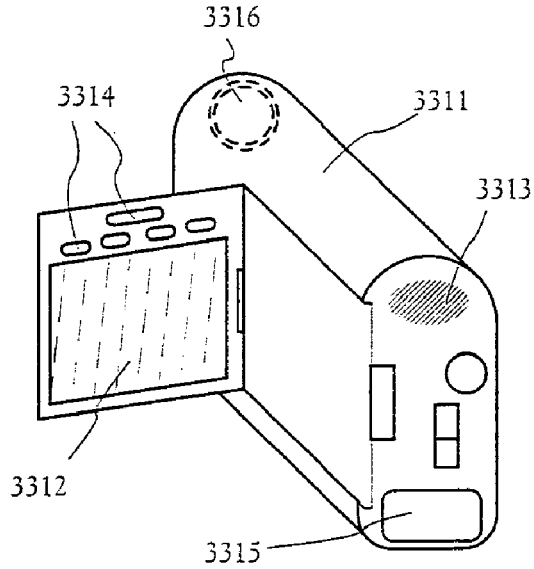

FIG. 22B is a video camera, containing a main body 3311, a display portion 3312, an audio input portion 3313, operation switches 3314, a battery 3315, and an image receiving portion 3316. The liquid crystal display device of the present invention can be used in the display portion 3312.

Figure 22C:
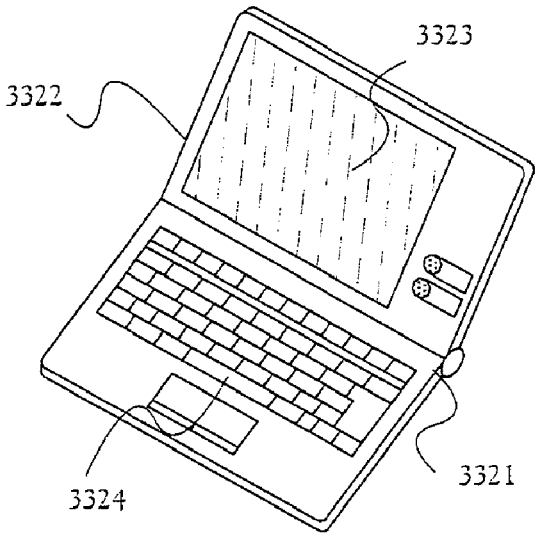

FIG. 22C is a personal computer, containing a main body 3321, a casing 3322, a display portion 3323, and a keyboard 3324. The liquid crystal display device of the present invention can be used in the display portion 3323.

Figure 22D:
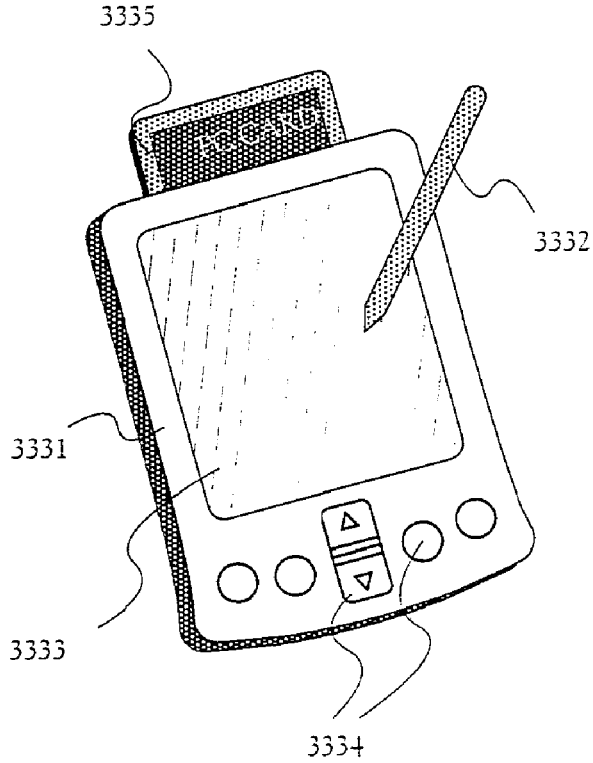

FIG. 22D is a portable information terminal, containing a main body 3331, a stylus 3332, a display portion 3333, an operation button 3334, and an external interface 3335. The liquid crystal display device of the present invention can be used in the display portion 3333.

Figure 23A:
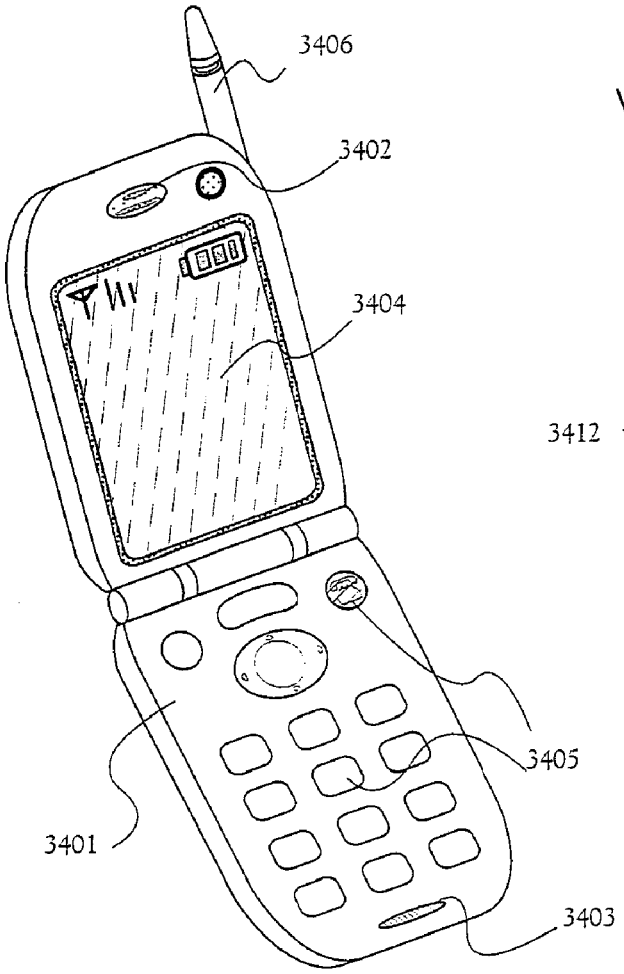
FIGS. 23A to 23C are diagrams showing examples of electronic equipment to which the liquid crystal display device of the present invention is applied in Embodiment 6.

FIG. 23A is a portable telephone, containing a main body 3401, an audio output portion 3402, an audio input portion 3403, a display portion 3404, operation switches 3405, and an antenna 3406. The liquid crystal display device of the present invention can be used in the display portion 3404.

Figure 23B:
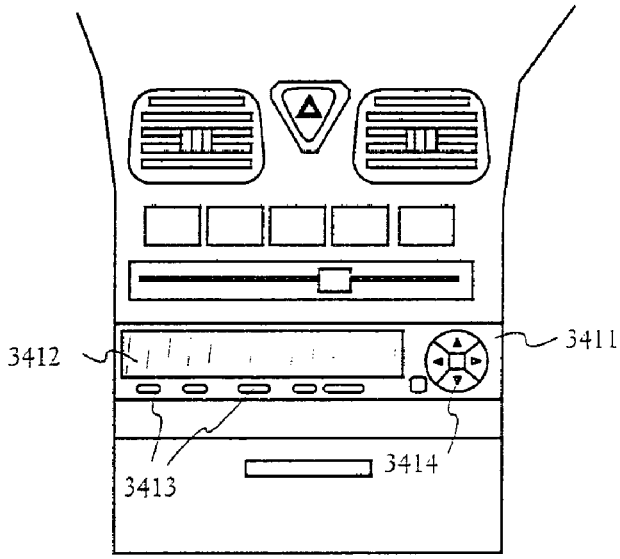

FIG. 23B is an audio reproducing device, specifically a car audio system, containing a main body 3411, a display portion 3412, and operation switches 3413 and 3414. The liquid crystal display device of the present invention can be used in the display portion 3412. Furthermore, an audio reproducing device for a car is shown in Embodiment 6, but it may also be used for a mobile type and a domestic type of audio reproducing device.

Figure 23C:
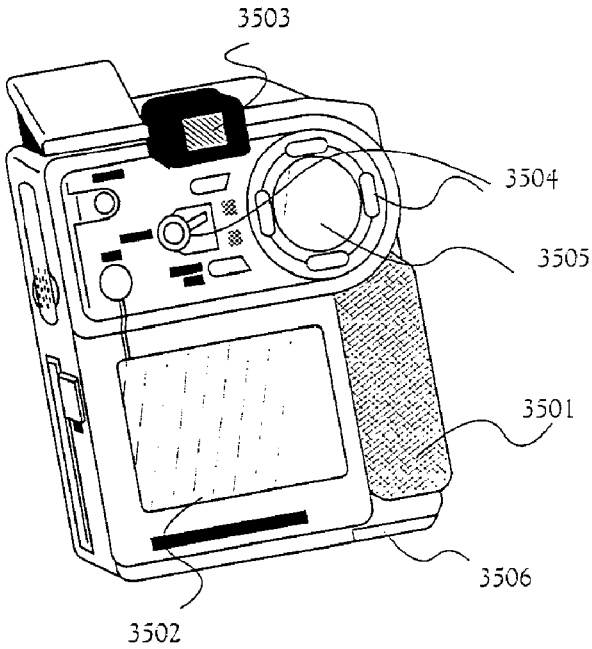

FIG. 23C is a digital camera, containing a main body 3501, a display device (A) 3502, a view finder 3503, an operation switches 3504, a display portion (B) 3505 and a battery 3506. The liquid crystal device of the present invention can be used in the display device (A) 3502 and a display portion (B) 3505.

The range of applications of the present invention is thus extremely wide, and it is possible to apply the present invention to electronic devices in all fields. Furthermore, any constitution of the liquid crystal display device shown in Embodiments 1 to 5 may be employed in the electronic devices of Embodiment 6.

In the liquid crystal display device of the present invention, storage of the digital image signal is conducted by using the memory circuits arranged in each of the pixels. Thus, in displaying the static image, the digital image signal stored in the memory circuits is repeatedly used, whereby it is possible to stop the source signal line driver circuit and the gate signal line driver circuit in continuously performing the static image display. Further, it is possible to stop the circuit such as the image signal processing circuit for processing the signal to be input to the liquid crystal display device in continuously performing the static image display. Thus, this greatly contributes to the low power consumption of the liquid crystal display device.

What is claimed is:

1. A liquid crystal display device comprising a plurality of pixels, each of the pixels comprising:

a first memory circuit;

a second memory circuit;

a first switch electrically connected to the first memory circuit;

a second switch electrically connected to the second memory circuit;

a decoder electrically connected to the first memory circuit and the second memory circuit;

a switch circuit electrically connected to the decoder;

power source lines electrically connected to the switch circuit; and a liquid crystal element electrically connected to one of the power source lines through the switch circuit.

2. A liquid crystal display device according to claim 1, wherein the first and second memory circuits are static type memories.

3. A liquid crystal display device according to claim 1, wherein the first and second memory circuits are formed over a substrate selected from the group consisting of a glass substrate, a plastic substrate, a stainless substrate, and a single crystal wafer.

4. An electronic apparatus having the liquid crystal display device according to claim 1, wherein the electronic apparatus is selected from the group consisting of a liquid crystal display apparatus, a personal computer, a portable information terminal, a car audio system, and a digital camera.

5. A liquid crystal display device comprising a plurality of pixels, each of the pixels comprising:

n memory circuits, wherein n is equal or greater than 2;

n switches, wherein each of the n switches is electrically connected to a corresponding one of the n memory circuits;

a decoder electrically connected to the n memory circuits;

a switch circuit comprising $2^n$ transistors electrically connected to the decoder;

$2^n$ power source lines electrically connected to the $2^n$ transistors, respectively; and a liquid crystal element electrically connected to one of the power source lines through one of the transistors.

6. A liquid crystal display device according to claim 5, wherein the n memory circuits are static type memories.

7. A liquid crystal display device according to claim 5, wherein the n memory circuits are formed over a substrate selected from the group consisting of a glass substrate, a plastic substrate, a stainless substrate, and a single crystal wafer.

8. An electronic apparatus having the liquid crystal display device according to claim 5, wherein the electronic apparatus is selected from the group consisting of a liquid crystal display apparatus, a personal computer, a portable information terminal, a car audio system, and a digital camera.

9. A liquid crystal display device comprising a plurality of pixels, each of the pixels comprising:

a first memory circuit;

a second memory circuit;

a first switch electrically connected to the first memory circuit;

a second switch electrically connected to the second memory circuit;

a decoder being inputted signals from the first memory circuit and the second memory circuit;

a switch circuit being inputted a signal from the decoder;

power source lines one of which is selected by the switch circuit; and a liquid crystal element electrically connected to the selected power source line through the switch circuit.

10. A liquid crystal display device according to claim 9, wherein the first and second memory circuits are formed over a substrate selected from the group consisting of a glass substrate, a plastic substrate, a stainless substrate, and a single crystal wafer.

11. A liquid crystal display device according to claim 9 wherein the first and second memory circuits are static type memories.

12. An electronic apparatus having the liquid crystal display device according to claim 9, wherein the electronic apparatus is selected from the group consisting of a liquid crystal display apparatus, a personal computer, a portable information terminal, a car audio system, and a digital camera.

13. A liquid crystal display device comprising a plurality of pixels, each of the pixels comprising:

n memory circuits, wherein n is equal or greater than 2;

n switches, wherein each of the n switches is electrically connected to a corresponding one of the n memory circuits;

a decoder being inputted signals from the n memory circuits;

a switch circuit comprising $2^n$ transistors, wherein one of the transistors is selected based on an output of the decoder;

$2^n$ power source lines one of which is electrically connected to the selected transistor is selected; and a liquid crystal element electrically connected to the selected power source line.

14. A liquid crystal display device according to claim 13, wherein the n memory circuits are static type memories.

15. A liquid crystal display device according to claim 13, wherein the n memory circuits are formed over a substrate selected from the group consisting of a glass substrate, a plastic substrate, a stainless substrate, and a single crystal wafer.

16. An electronic apparatus having the liquid crystal display device according to claim 13, wherein the electronic apparatus is selected from the group consisting of a liquid crystal display apparatus, a personal computer, a portable information terminal, a car audio system, and a digital camera.

* * * * *